US005285642A

United States Patent [19]

Watanabe et al.

[11] Patent Number: 5,285,642

[45] Date of Patent: Feb. 15, 1994

[54] LOAD SENSING CONTROL SYSTEM FOR HYDRAULIC MACHINE

[75] Inventors: Hiroshi Watanabe, Ushiku; Yasuo Tanaka, Tsukuba; Eiki Izumi; Hiroshi Onoue, both of Ibaraki; Shigetaka Nakamura, Tsuchiura, all of Japan

[73] Assignee: Hitachi Construction Machinery Co., Ltd., Tokyo, Japan

[21] Appl. No.: 857,934

[22] PCT Filed: Sep. 27, 1991

[86] PCT No.: PCT/JP91/01296

§ 371 Date: May 19, 1992

§ 102(e) Date: May 19, 1992

[87] PCT Pub. No.: WO92/06306

PCT Pub. Date: Apr. 16, 1992

[30] Foreign Application Priority Data

Sep. 28, 1990 [JP] Japan ..... 2-259712

[51] Int. Cl.[5] ..... F16D 31/02

[52] U.S. Cl. ..... 60/452; 60/426; 91/518; 91/446

[58] Field of Search ..... 60/420, 426, 445, 449, 60/452; 91/508, 511, 514, 518, 531, 446

[56] References Cited

U.S. PATENT DOCUMENTS

| | | | |
|---|---|---|---|
| 4,617,854 | 10/1986 | Kropp | 91/517 |
| 4,809,504 | 3/1989 | Izumi et al. | 60/449 X |
| 4,856,278 | 8/1989 | Widmann et al. | 60/452 X |
| 4,938,023 | 7/1990 | Yoshino | 91/518 X |
| 5,085,051 | 2/1992 | Hirata | 60/368 |
| 5,170,625 | 12/1992 | Watanabe et al. | 91/511 |
| 5,177,964 | 1/1993 | Tanaka et al. | 60/452 X |

FOREIGN PATENT DOCUMENTS

| | | | |
|---|---|---|---|
| 440802 | 8/1991 | European Pat. Off. . | |
| 60-11706 | 1/1985 | Japan . | |
| 61-88002 | 5/1986 | Japan . | |
| 2-76904 | 3/1990 | Japan . | |
| 2-153128 | 6/1990 | Japan | 91/511 |
| 91/02167 | 2/1991 | PCT Int'l Appl. . | |

*Primary Examiner*—Edward K. Look
*Assistant Examiner*—Hoang Nguyen
*Attorney, Agent, or Firm*—Fay, Sharpe, Beall, Fagan, Minnich & McKee

[57] ABSTRACT

A load sensing control system for a hydraulic machine sets a variable target differential pressure between a delivery pump pressure and a load pressure of an actuator. A control factor is determined that becomes larger as the deviation between the target differential pressure and the actual differential pressure is increased, and that becomes smaller as the differential pressure deviation is decreased. The control factor also becomes larger as the target differential pressure becomes smaller. The target displacement volume for the hydraulic pump is based on the differential pressure deviation, which is calculated from the target differential pressure and the control factor.

11 Claims, 16 Drawing Sheets

LOAD SENSING CONTROL SYSTEM FOR HYDRAULIC MACHINE

TECHNICAL FIELD

The present invention relates to a control system for a hydraulic pump in a hydraulic drive circuit for use in hydraulic machines such as hydraulic excavators and cranes, and more particularly to a control system for a hydraulic pump in a hydraulic drive circuit of load sensing control type which controls a pump delivery rate in such a manner as to hold the delivery pressure of the hydraulic pump higher by a fixed value than the load pressure of a hydraulic actuator.

BACKGROUND ART

Hydraulic drive circuits for use in hydraulic machines such as hydraulic excavators and cranes each comprise at least one hydraulic pump, at least one hydraulic actuator driven by a hydraulic fluid delivered from the hydraulic pump, and a flow control valve connected between the hydraulic pump and the actuator for controlling a flow rate of the hydraulic fluid supplied to the actuator. It is known that some of those hydraulic drive circuits employ a technique called load sensing control (LS control) for controlling the delivery rate of the hydraulic pump. The load sensing control is to control the delivery rate of the hydraulic pump such that a delivery pressure of the hydraulic pump is held higher by a fixed value than a load pressure of the hydraulic actuator. This causes the delivery rate of the hydraulic pump to be controlled dependent on the load pressure of the hydraulic actuator, and hence permits economic operation.

Meanwhile, the load sensing control is carried out by detecting a differential pressure (LS differential pressure) between the delivery pressure and the load pressure, and controlling the displacement volume of the hydraulic pump, or the position (tilting amount) of a swash plate in the case of a swash plate pump, in response to a deviation between the LS differential pressure and a differential pressure target value. Conventionally, the detection of the differential pressure and the control of the tilting amount of the swash plate have usually been carried out in a hydraulic manner as disclosed in JP, A, 60-11706, for example. This conventional arrangement will briefly be described below.

A pump control system disclosed in JP, A, 60-11706 comprises a control valve having one end subjected to the delivery pressure of a hydraulic pump and the other end subjected to both the maximum load pressure among a plurality of actuators and the urging force of a spring, and a cylinder unit operation of which is controlled by a hydraulic fluid passing through the control valve for regulating the swash plate position of the hydraulic pump. The spring at one end of the control valve is to set a target value of the LS differential pressure. Depending on the deviation occurring between the LS differential pressure and the target value thereof, the control valve is driven and the cylinder unit is operated to regulate the swash plate position, whereby the pump delivery rate is controlled so that the LS differential pressure is held at the target value. The cylinder unit has a spring built therein to apply an urging force in opposite relation to the direction in which the cylinder unit is driven upon inflow of the hydraulic fluid.

However, the above conventional control system for the hydraulic pump has had the following problem.

In the conventional pump control system, the tilting speed of a swash plate of the hydraulic pump is determined dependent on the flow rate of the hydraulic fluid flowing into the cylinder unit, while that flow rate of the hydraulic fluid is determined dependent on both an opening, i.e., a position, of the control valve and setting of the spring in the cylinder unit and, in turn, the position of the control valve is determined by the relationship between the urging force of the LS differential pressure and the spring force for setting the target value. Here, the spring of the control valve and the spring of the cylinder unit each have a fixed spring constant. Accordingly, a control gain for the tilting speed of the swash plate dependent on the deviation between the LS differential pressure and the target value thereof is always constant. The control gain, i.e., the spring constants of the two springs, are set in such a range that change in the pump delivery pressure will not cause hunting and the pump is kept from coming into disablement of control on account of change in the delivery rate upon change in the swash plate position.

In the LS control, the delivery pressure of the hydraulic pump is determined dependent on a difference between the flow rate of the hydraulic fluid flowing into a line, extending from the hydraulic pump to the flow control valve, and the flow rate of the hydraulic fluid flowing out of the line, as well as a line volume into which the delivered hydraulic fluid is allowed to flow. Therefore, when the operation (input) amount of the flow control valve (i.e., the demanded flow rate) is small, the opening of the flow control valve is so reduced that the small line volume between the hydraulic pump and the flow control valve plays a predominant factor. As a result, the delivery pressure is largely varied even with a slight change in the flow rate upon change in the swash plate position. On the other hand, when the operation amount of the flow control valve is increased to enlarge the opening thereof, the large line volume between the pump and an actuator now takes part in the pressure change, whereby change in the delivery pressure upon change in the delivery rate is reduced.

Accordingly, in order to reliably perform the LS control over a range of the entire operation amount (opening) of the flow control valve without causing hunting, the above-mentioned control gain, i.e., the spring constants of the two springs, are set to a relatively small value such that a tilting speed of the swash plate to prevent the pressure change from hunting at the small opening of the flow control valve is provided.

Meanwhile, when a control lever is operated, the operator tends to operate the control lever at a speed corresponding to the speed change demanded for the actuator. With the operating speed of the control lever being small, the difference between the demanded flow rate of the flow control valve and the delivery rate of the hydraulic pump is small, and so is a deviation between a differential pressure signal, determined from the pump delivery pressure and the maximum load pressure, and the target differential pressure set by the spring. In this case, because the operating speed of the control lever is small, the control gain set by the two springs as mentioned above can provide sufficient change in the tilting speed of the swash plate, i.e., the sufficient delivery rate of the hydraulic pump, to realize demanded speed change of the actuator.

However, when the operating speed of the control lever is large, i.e., when the control lever is operated abruptly, there occurs a large difference between the demanded flow rate of the flow control valve and the delivery rate of the hydraulic pump, which also increases the deviation between the differential pressure signal, determined from the pump delivery pressure and the maximum load pressure, and the target differential pressure set by the spring. In this case, with the control gain set by the two springs as mentioned above, the tilting speed of the swash plate, i.e., change in the delivery rate of the hydraulic pump, is limited and becomes insufficient. Accordingly, the demanded speed change of the actuator cannot be realized, causing the operator to feel that the actuator is too slow in action.

To solve the above problem, therefore, the present inventors have proposed in International Application No. PCT/JP90/00962 (International Application Date: Jul. 27, 1990; International Laid-Open No. WO91/02167; International Laid-Open Date: Feb. 21, 1991) a control system for a hydraulic pump characterized in comprising first means for determining, based on a delivery pressure of a hydraulic pump and a maximum load pressure among a plurality of actuators, a target displacement volume (a tilting amount of a swash plate) of the hydraulic pump to reduce a differential pressure deviation between the above differential pressure and a preset target differential pressure, second means for determining a control gain of the first means to becomes larger with the differential pressure deviation increasing and smaller with the differential pressure deviation decreasing, and third means for controlling displacement volume varying means (swash plate) of the hydraulic pump so that the displacement volume of the hydraulic pump is matched with the target displacement volume determined by the first means.

With the above arrangement, in a range where the operating speed of the control lever is small and so is the differential pressure deviation, the control gain determined by the second means also becomes small to reduce the tilting speed of the swash plate. This enables stable control in which there occurs no hunting due to abrupt change in the delivery pressure. On the other hand, when the operating speed of the control lever is large, i.e., when the control lever is operated abruptly and the differential pressure deviation is increased, the control gain determined by the second means also becomes large to raise the tilting speed of the swash plate, thus enabling a response that is not slow but prompt. By so doing, the delivery pressure of the hydraulic pump can always be controlled in an optimum way regardless of the operating speed of the control lever.

The present invention is intended to further improve the above prior application and solve the problem encountered in the case of making the target differential pressure variable.

More specifically, while the target differential pressure between the pump delivery pressure and the maximum load pressure is usually set constant in the load sensing control, it has been proposed to make the target differential pressure variable for various purposes. One example is disclosed in JP, A, 2-76904. In this proposed technique, the target differential pressure can be changed externally for the purpose of facilitating fine speed operation of an actuator. By setting the target differential pressure to a small value, the displacement volume of the hydraulic pump is controlled so as to keep the small target differential pressure. As a result, since the differential pressure across the flow control valve also becomes small by being restricted by the small target differential pressure, metering characteristics of the flow control valve are changed to reduce the flow rate of the hydraulic fluid supplied to the actuator and the fine speed operation of the actuator can easily be realized.

In the case of making the target differential pressure so variable, however, at the small target differential pressure, the differential pressure deviation cannot exceed the target differential pressure and the differential pressure deviation is also limited to a small maximum value, leading to that when the operating speed of the control lever is large, i.e., when the control lever is operated abruptly, there can be obtained only a limited small differential pressure deviation. Accordingly, even if the control gain is set dependent on the differential pressure deviation as with the foregoing prior application, the obtained control gain is small and the tilting speed of the swash plate is so limited that the actuator is forced to move slowly.

An object of the present invention is to provide a control system for a hydraulic pump which, when a target differential pressure for load sensing control is set as a variable value, can perform stable control at a small operating speed of the control means without causing hunting and achieve a response, not slow but prompt, at a large operating speed of the control means, no matter what the value of the target differential pressure.

DISCLOSURE OF THE INVENTION

To achieve the above object, according to the present invention, there is provided a control system for a hydraulic pump in a hydraulic drive circuit of load sensing control type comprising at least one hydraulic pump of displacement volume type, at least one hydraulic actuator driven by a hydraulic fluid delivered from said hydraulic pump, and a flow control valve connected between said hydraulic pump and said actuator for controlling a flow rate of the hydraulic fluid supplied to said actuator, wherein a target displacement volume is determined based on a differential pressure deviation between a differential pressure, in turn between a delivery pressure of said hydraulic pump and a load pressure of said actuator, and a target differential pressure is determined, and a displacement volume of said hydraulic pump is controlled so that said differential pressure between the delivery pressure and the load pressure is held at said target differential pressure, said control system for a hydraulic pump further comprising first means including said target differential pressure set as a variable value; second means for determining a control factor that becomes larger as said differential pressure deviation calculated from said target differential pressure as a variable value is increased, and becomes smaller as said differential pressure deviation is decreased, and also that becomes large at a relatively small value of said differential pressure deviation when said target differential pressure is small; and third means for determining said target displacement volume based on said differential pressure deviation calculated from said target differential pressure as a variable value and said control factor.

With the present invention thus arranged, when the target differential pressure set by the first means is large, an operating speed of control means is small and the differential pressure deviation is small. The small control factor is determined by the second means and thus a change speed of the displacement volume is reduced. Therefore, change in the pump delivery pressure becomes so small as to enable stable control in which there occurs no hunting due to abrupt changes in the pump delivery pressure. With the target differential pressure being similarly large, when the operating speed of the control means is large, i.e., when the control means is quickly operated to increase the differential pressure deviation, the large control factor is determined by the second means and thus the change speed of the displacement volume is increased, thereby enabling a response not slow but prompt. Accordingly, the delivery pressure of the hydraulic pump can be always controlled in such an optimum manner as to be not slow in response and as to not cause no hunting irrespective of the operating speed of the control means.

When the small differential pressure is set by the first means, the large control factor is determined by the second means at a relatively small value of the differential pressure deviation, whereby even if the differential pressure deviation obtained at the large operating speed of the control means is reduced corresponding to the small target differential pressure, the large control factor can be obtained. Therefore, the change speed of the displacement volume is increased similarly to the case of the large target differential pressure, enabling to carry out prompt control free from slow change in the pump delivery rate. Accordingly, the pump delivery pressure can be optimumly controlled in such a manner as to be not slow in response and so as to not cause hunting irrespective of not only the operating speed of the control means but also the magnitude of the target differential pressure as a variable value.

Preferably, said second means comprises fourth means for modifying a change width of said differential pressure deviation to be enlarged when said target differential pressure is small, and fifth means for determining said control factor based on the modified differential pressure deviation. Said fourth means preferably comprises means for calculating a first modifying factor that becomes larger as said target differential pressure is decreased, and means for multiplying said differential pressure deviation by said first modifying factor to modify said differential pressure deviation. Said fifth means preferably comprises means for calculating, from said modified differential pressure deviation, a second modifying factor that becomes larger as said modified differential pressure deviation is increased, and becomes smaller as said modified differential pressure deviation is decreased, means including a basic control factor set in advance, and means for multiplying said basic control factor by said second modifying factor to calculate said control factor.

Further, said second means may comprise means for calculating a first modifying factor that becomes larger as said target differential pressure is decreased, means for calculating, from said differential pressure deviation, a second modifying factor that becomes larger as said differential pressure deviation is increased, and becomes smaller as said differential pressure deviation is decreased, and means for multiplying said first modifying factor by said second modifying factor to calculate said control factor.

Alternatively, said second means may comprises means for calculating a second modifying factor that becomes larger as said differential pressure deviation is increased, and becomes smaller as said differential pressure deviation is decreased, and also that becomes large at a relatively small value of said differential pressure deviation when said target differential pressure is small, means including a basic control factor set in advance, and means for multiplying said basic control factor by said second modifying factor to calculate said control factor.

Preferably, the control system for the hydraulic pump further comprises means for detecting a revolution speed of a prime mover to drive said hydraulic pump, and said first means sets said target differential pressure as a value that becomes larger as said detected revolution speed is increased, and becomes smaller as said detected revolution speed is decreased.

With such an arrangement, when the operator lowers the revolution speed of the prime mover with an intention of doing fine speed operation of the actuator, the target differential pressure becomes small with the reduced revolution speed of the prime mover. Correspondingly, the differential pressure between the delivery pressure of the hydraulic pump and the load pressure of the actuator becomes small, and so does the differential pressure across the flow control valve. This also reduces the flow rate of the hydraulic fluid supplied to the actuator, making it possible to facilitate the fine speed operation corresponding to the operator's intention and improve the operability.

Preferably, the control system for the hydraulic pump further comprises means for detecting a temperature of the hydraulic fluid in said hydraulic drive circuit, and said first means sets said target differential pressure as a value that becomes smaller as said detected fluid temperature is raised, and becomes larger as said detected fluid temperature is lowered.

With such an arrangement, since the target differential pressure becomes large in works under the low-temperature environment, it is possible to prevent a reduction in the flow rate of the hydraulic fluid supplied to the actuator and thus improve the working efficiency.

Preferably, the control system for the hydraulic pump further comprises means for outputting a work mode signal to designate a work mode of a hydraulic machine mounting said hydraulic drive circuit thereon, and said first means stores a plurality of different target differential pressures respectively corresponding to a plurality of work modes and selects the target differential pressure corresponding to the work mode designated by said work mode signal.

With such an arrangement, since the optimum target differential pressure is set dependent on the work mode, optimum metering characteristics dependent on the contents of work can be provided to further improve the working efficiency.

Preferably, the control system for the hydraulic pump further comprises means for detecting a revolution speed of a prime mover to drive said hydraulic pump, means for detecting a temperature of the hydraulic fluid in said hydraulic drive circuit, and means for outputting a work mode signal to designate a work mode of a hydraulic machine mounting said hydraulic drive circuit thereon, and said first means comprises means for calculating a revolution speed modifying factor that becomes larger as said detected revolution speed is increased, and becomes smaller as said detected revolution speed is decreased, means for calculating a fluid temperature modifying factor that becomes smaller as said detected fluid temperature is raised, and becomes larger as said detected fluid temperature is lowered, means for storing a plurality of different target differential pressures respectively corresponding to a plurality of work modes and selecting the target differential pressure corresponding to the work mode designated by said work mode signal, and means for calculating said target differential pressure as a variable value from said target differential pressure corresponding to the designated work mode, said revolution speed modifying factor and said fluid temperature modifying factor.

With such an arrangement, an improvement in the fine speed operation at the lowered revolution speed of the prime mover, an increase in the working efficiency under the low-temperature environment, and an advantage resulted from setting metering characteristics dependent on the contents of work can be realized simultaneously.

Preferably, said fourth means comprises means for multiplying said differential pressure deviation by said control factor to calculate a target change speed of said displacement volume, and means for adding said target change speed to the target displacement volume obtained in the last cycle to determine a new target displacement volume.

BEST MODE FOR CARRYING OUT THE INVENTION

Hereinafter, one embodiment of the present invention will be described with reference to FIGS. 1–14.

Figure 1:
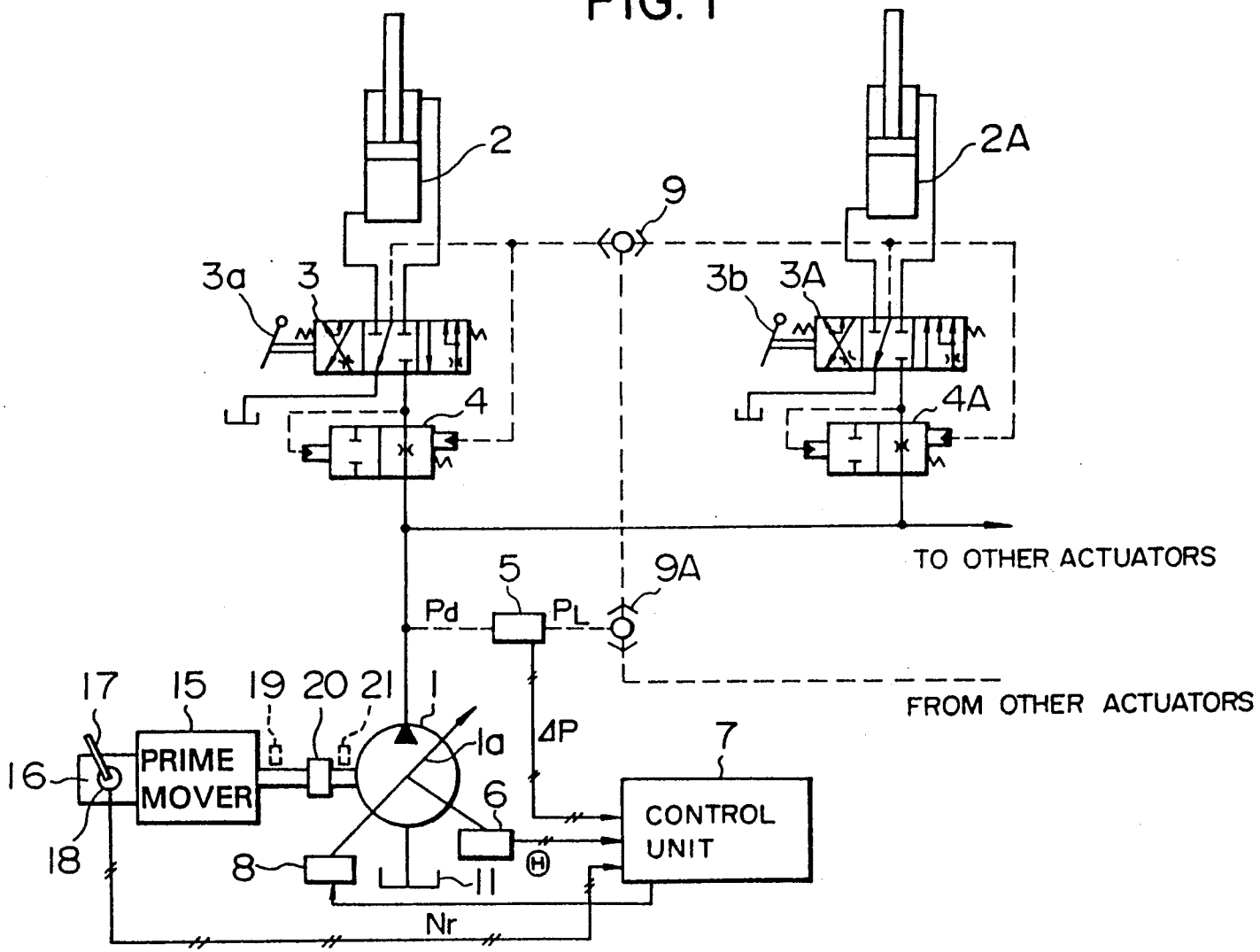
FIG. 1 is a schematic diagram of a hydraulic drive circuit of load sensing control type equipped with a control system for a hydraulic pump according to one embodiment of the present invention.

In FIG. 1, a hydraulic drive circuit according to this embodiment is mounted on hydraulic excavators such as hydraulic machines and comprises a hydraulic pump 1, a plurality of hydraulic actuators 2, 2A driven by a hydraulic fluid delivered from the hydraulic pump 1, flow control valves 3, 3A connected between the hydraulic pump 1 and the actuators 2, 2A for controlling flow rates of the hydraulic fluid supplied to the actuators 2, 2A dependent on operation of control levers 3*a*, 3*b*, respectively, and pressure compensating valves 4, 4A for holding constant differential pressures between the upstream and downstream sides of the flow control valves 3, 3A, i.e., differential pressures across those valves, to control the flow rates of the hydraulic fluid passing through the flow control valves 3, 3A to values in proportion to openings of the flow control valves 3, 3A, respectively. A set of the flow control valve 3 and the pressure compensating valve 4 constitutes one pressure compensated flow control valve, while a set of the flow control valve 3A and the pressure compensating valve 4A constitutes another pressure compensated flow control valve. The hydraulic pump 1 has a swash plate 1*a* as a displacement volume varying mechanism.

The hydraulic pump 1 is driven by a prime mover 15. The prime mover 15 is usually a diesel engine and its revolution speed is controlled by a fuel injector 16. The fuel injector 16 is an all-speed governer having a manual governer lever 17. By operating the governer lever 17, a target revolution speed is set dependent on the operation amount to control fuel injection.

The hydraulic pump 1 is controlled in its delivery rate by a control system which comprises a differential pressure sensor 5, a swash plate position sensor 6, a governer angle sensor 18, a control unit 7 and a swash plate position controller 8. The differential pressure sensor 5 detects a differential pressure (LS differential pressure) between a maximum load pressure PL among the plurality of actuators, including the actuators 2, 2A, selected by shuttle valves 9, 9A and a delivery pressure Pd of the hydraulic pump 1, and converts it into an electric signal ΔP for outputting to the control unit 7. The swash plate position sensor 6 detects a position (tilting amount) of a swash plate 1*a* of the hydraulic pump 1 and converts it into an electric signal $\theta$ for outputting to the control unit 7. The governer angle sensor 18 detects the operation amount of the governer lever 17 and converts it into an electric signal Nr for outputting to the control unit 7. The control unit 7 calculates a drive signal for the swash plate 1*a* of the hydraulic pump 1 based on the electric signals ΔP, $\theta$, Nr and outputs the drive signal to the swash plate position controller 8. In response to the drive signal from the control unit 7, the swash plate position controller 8 drives the swash plate 1*a* for controlling the pump delivery rate.

Figure 2:
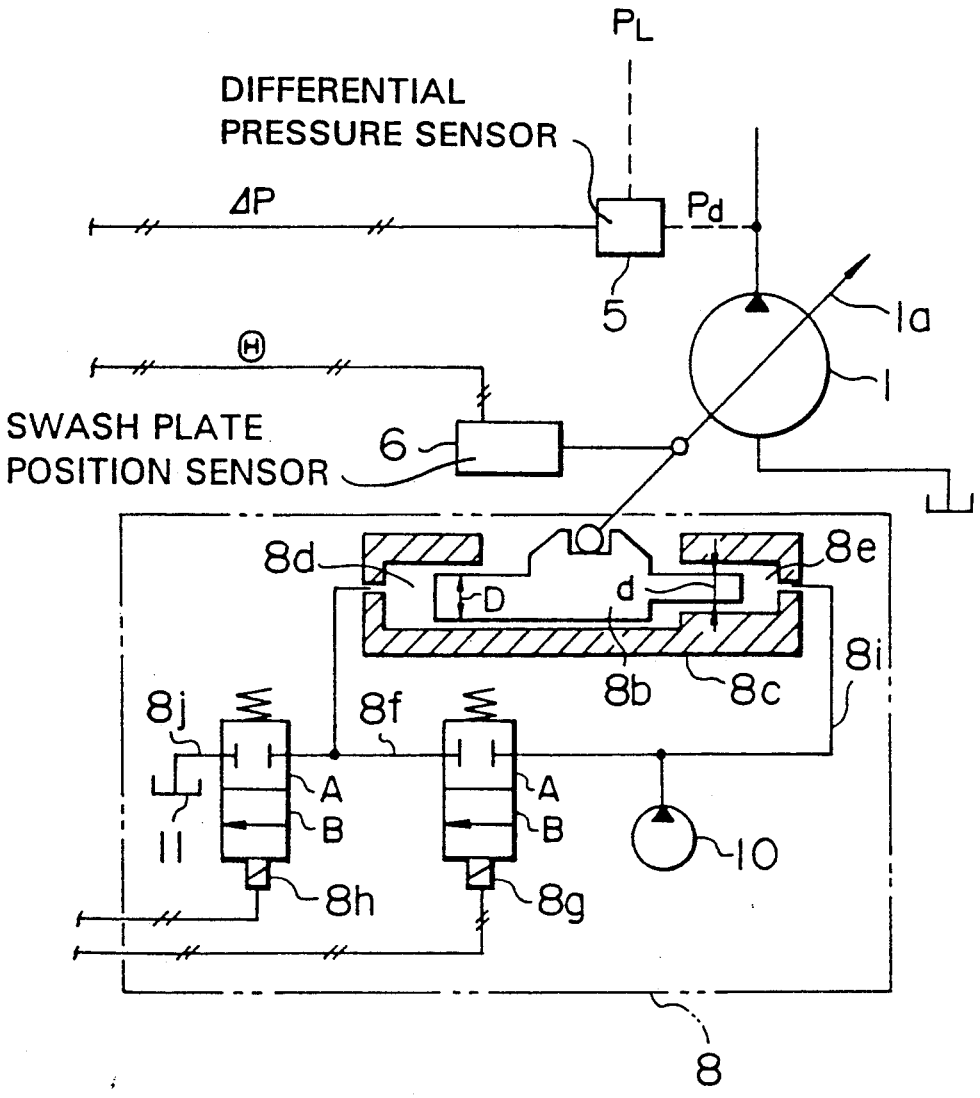
FIG. 2 is a schematic diagram showing the arrangement of a swash plate position controller.

The swash plate position controller 8 is constituted as a hydraulic drive device of electro-hydraulic servo type, for example, as shown in FIG. 2.

More specifically, the swash plate position controller 8 has a servo piston 8*b* for driving the swash plate 1*a* of the hydraulic pump 1, the servo piston 8*b* being housed in a servo cylinder 8*c*. A cylinder chamber of the servo cylinder 8*c* is partitioned by the servo piston 8*b* into a left-hand chamber 8*d* and a right-hand chamber 8*e*. These chambers are formed such that the cross-sectional area D of the left-hand chamber 8*d* is larger than the cross-sectional area d of the right-hand chamber 8*e*.

The left-hand chamber 8*d* of the servo cylinder 8*c* is communicated with a hydraulic source 10 such as a pilot pump via a line 8*f*, and the right-hand chamber 8*e* of the servo cylinder 8*c* is communicated with the hydraulic source 10 via a line 8*i*, the line 8*f* being communicated with a reservoir (tank) 11 via a return line 8*j*. A solenoid valve 8*g* is disposed midway the line 8*f*, and a solenoid valve 8*h* is disposed midway the return line 8*j*. These solenoid valves 8*g*, 8*h* are each a normally closed solenoid valve (with the function of returning to a closed state upon deenergization), and switched over by the drive signal from the control unit 7.

When the solenoid valve 8*g* is energized (turned on) for switching to its open position B, the left-hand chamber 8*d* of the servo cylinder 8*c* is communicated with the hydraulic source 10, whereupon the servo piston 8*b* is forced to move rightwardly on the drawing sheet of FIG. 2 due to the difference in cross-sectional area between the left-hand chamber 8*d* and the right-hand chamber 8*e*. This increases a tilting angle of the swash plate 1*a* of the hydraulic pump 1 and hence the delivery rate. When the solenoid valve 8*g* and the solenoid valve 8*h* are both deenergized (turned off) for returning to their closed positions A, the fluid (oil) passage leading to the left-hand chamber 8*d* is cut off and the servo piston 8*b* remains at rest in that position. The tilting angle of the swash plate 1*a* of the hydraulic pump 1 is thereby kept constant, and so is the delivery rate. When the solenoid valve 8*h* is energized (turned on) for switching to its open position B, the left-hand chamber 8*d* of the servo cylinder 8*c* is communicated with the reservoir 11 to reduce the pressure in the left-hand chamber 8*d*, whereby the servo piston 8*b* is forced to move leftwardly on the drawing sheet of FIG. 2 under an action of the pressure in the right-hand chamber 8*e*. This decreases the tilting angle of the swash plate 1*a* of the hydraulic pump 1 and hence the delivery rate.

Figure 3:
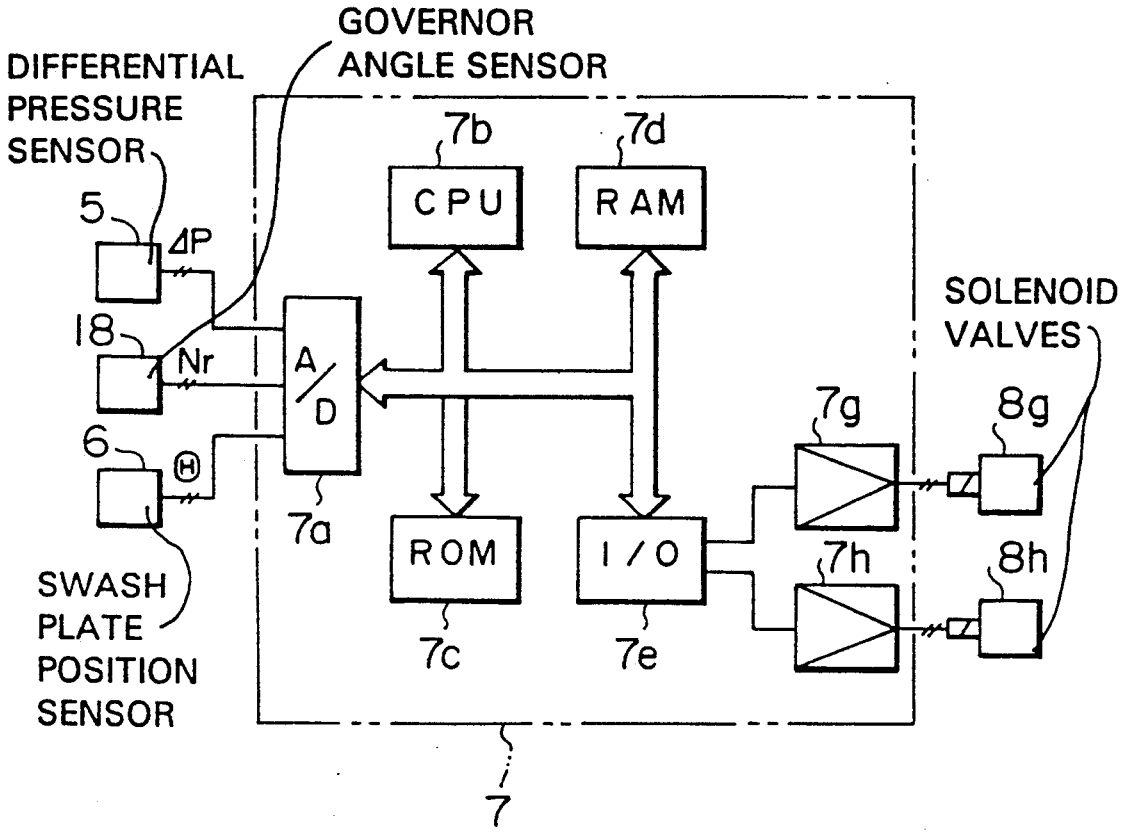
FIG. 3 is a schematic diagram showing the arrangement of a control unit.

The control unit 7 is constituted by a microcomputer and, as shown in FIG. 3, comprises an A/D converter 7*a* for converting the differential pressure signal ΔP outputted from the differential pressure sensor 5, the swash plate position signal θ outputted from the swash plate position sensor 6 and the operation amount signal Nr of the governer lever 17 outputted from the governor angle sensor 18 into respective digital signals, a central processing unit (CPU) 7*b*, a read only memory (ROM) 7*c* for storing a program of the control sequence, a random access memory (RAM) 7*d* for temporarily storing numerical values under calculations, an I/O interface 7*e* for outputting the drive signals, and amplifiers 7*g*, 7*h* connected to the aforesaid solenoid valves 8*g*, 8*h*, respectively.

The control unit 7 calculates a swash plate target position θo from the differential pressure signal ΔP outputted from the differential pressure sensor 5 and the governer lever operation amount signal Nr outputted from the governer angle sensor 18 in accordance with the program of the control sequence stored in the ROM 7*c*, and creates the drive signals from the swash plate target position θo and the swash plate position signal θ outputted from the swash plate position sensor 6 to make a deviation therebetween zero, followed by outputting the drive signals to the solenoid valves 8*g*, 8*h* of the swash plate position controller 8 from the amplifiers 7*g*, 7*h* via the I/O interface 7*e*. The swash plate 1*a* of the hydraulic pump 1 is thereby controlled so that the swash plate position signal θ coincides with the swash plate target position θo.

Function and operation of this embodiment will be described below in detail by referring to a flowchart, shown in FIG. 4, of the control sequence program stored in the ROM 7*c*.

First, in a step 100, the respective signals ΔP, θ, Nr from the differential pressure sensor 5, the swash plate position sensor 6 and the governer angle sensor 18 are entered to the control unit via the A/D converter 7*a* and stored in the RAM 7*d* as the differential pressure ΔP, the swash plate position θ and the target revolution speed Nr, respectively.

Figure 5:
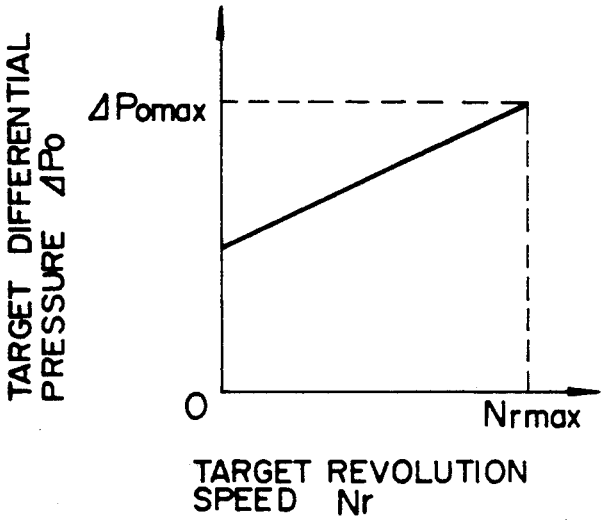
FIG. 5 is a graph showing the relationship between a target revolution speed Nr and a target differential pressure ΔPo.

Then, in a step 110, the target differential pressure ΔPo is calculated from the target revolution speed Nr read in the step 100. The calculation is made by previously storing table data as shown in FIG. 5 in the ROM 7*c*, and reading the target differential pressure ΔPo corresponding to the target revolution speed Nr from the table data. Alternatively, the target differential pressure ΔPo may be determined through arithmetic operation by programming the calculation formula in advance. The relationship between the target revolution speed Nr and the target differential pressure ΔPo in the table data has such characteristics that the target differential pressure ΔPo is increased as the target revolution speed Nr becomes higher and is decreased as the target revolution speed Nr becomes lower. In this embodiment, particularly, the characteristics are set such that a maximum target differential pressure ΔPomax obtained at a maximum Nrmax of the target revolution speed gives a standard target differential pressure suitable for usual operation of the hydraulic circuit shown in FIG. 1.

The reason of setting the relationship between the target revolution speed Nr and the target differential pressure ΔPo as mentioned before is as follows. Corresponding to an intention of the operator to reduce the revolution speed of the prime mover for fine speed operation, the target differential pressure ΔPo is made smaller so that the differential pressure across the flow control valve also becomes smaller. Thus, metering characteristics of the flow control valve are modified to reduce the flow rate of the hydraulic fluid supplied to the actuator, thereby facilitating the fine speed operation.

Then, in a step 120, a deviation Δ (ΔP) between the target differential pressure ΔPo determined in the step 110 and the differential pressure ΔP read in the step 100 is calculated.

Figure 6:
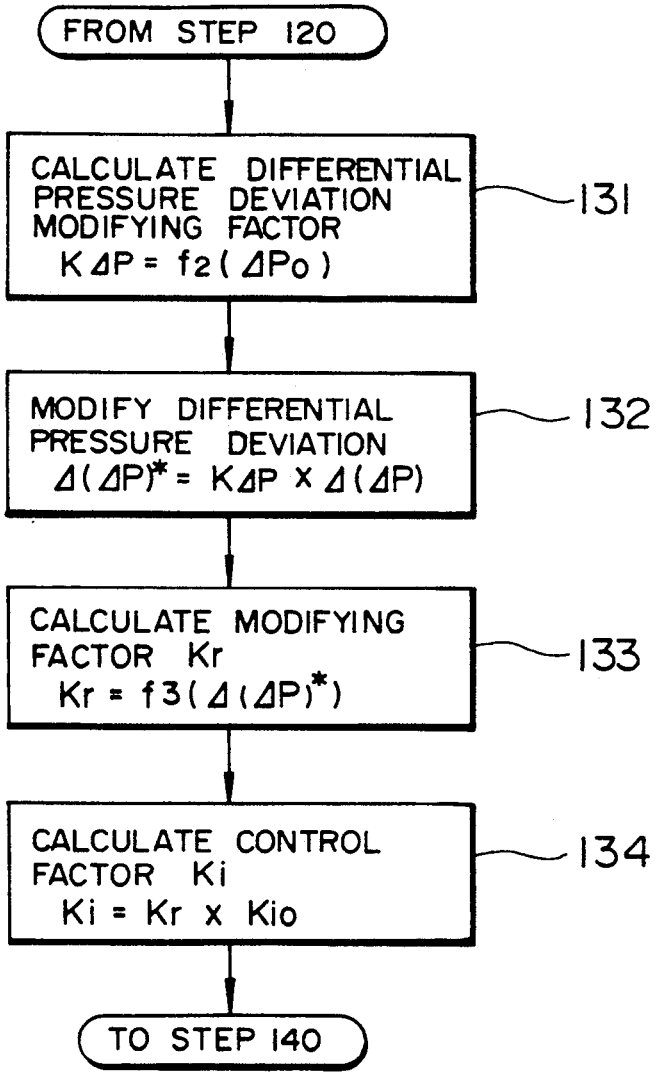
FIG. 6 is a flowchart showing details of a step of calculating a control factor Ki in the flowchart shown in FIG. 4.

Next, in a step 130, a control factor Ki for a tilting speed of the swash plate 1*a* is calculated. FIG. 6 shows details of the step 130.

Figure 7:
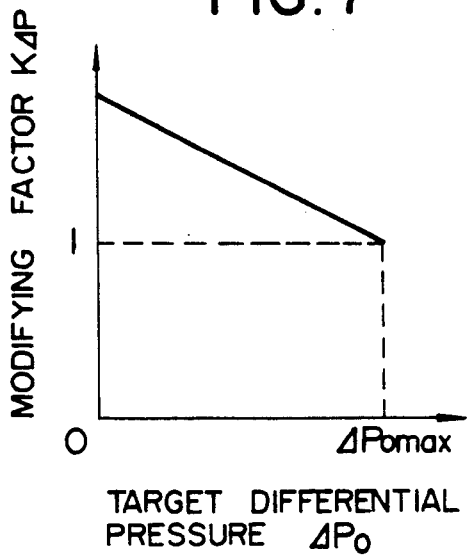
FIG. 7 is a graph showing the relationship between the target differential pressure ΔPo and a modifying factor $K_{\Delta Po}$.

In FIG. 6, a differential pressure deviation modifying factor, i.e., a first modifying factor $K_{\Delta P}$ is first calculated in a step 131. The calculation is made by previously storing table data as shown in FIG. 7 in the ROM 7c, and reading the modifying factor $K_{\Delta P}$ corresponding to the target differential pressure ΔPo determined in the step 110. Alternatively, the modifying factor $K_{\Delta P}$ may be determined through arithmetic operation by programming the calculation formula in advance. The relationship between the target differential pressure ΔPo and the modifying factor $K_{\Delta P}$ in the table data has such characteristics that, as shown in FIG. 7, the modifying factor $K_{\Delta P}$ is small at a maximum ΔPomax of the target differential pressure ΔPo, and the modifying factor $K_{\Delta P}$ becomes larger as the target differential pressure ΔPo is decreased. In this embodiment, particularly, the characteristics are set such that the modifying factor $K_{\Delta P}$ is equal to 1 at the maximum ΔPomax of the target differential pressure ΔPo. Note that the modifying factor $K_{\Delta P}$ corresponding to the maximum target differential pressure ΔPomax may be a value other than 1.

The reason of setting the relationship between the target differential pressure ΔPo and the modifying factor $K_{\Delta P}$ as mentioned before is as follows. As a result of making the target differential pressure ΔPo so variable, when the target differential pressure ΔPo is small, the differential pressure deviation Δ(ΔP) cannot exceed the target differential pressure and is also limited to a small value. In view of that, when the operating speed of the control lever is large, the small differential pressure deviation thus limited is modified to a value as large as that in the case where the target differential pressure is large.

Figure 4:
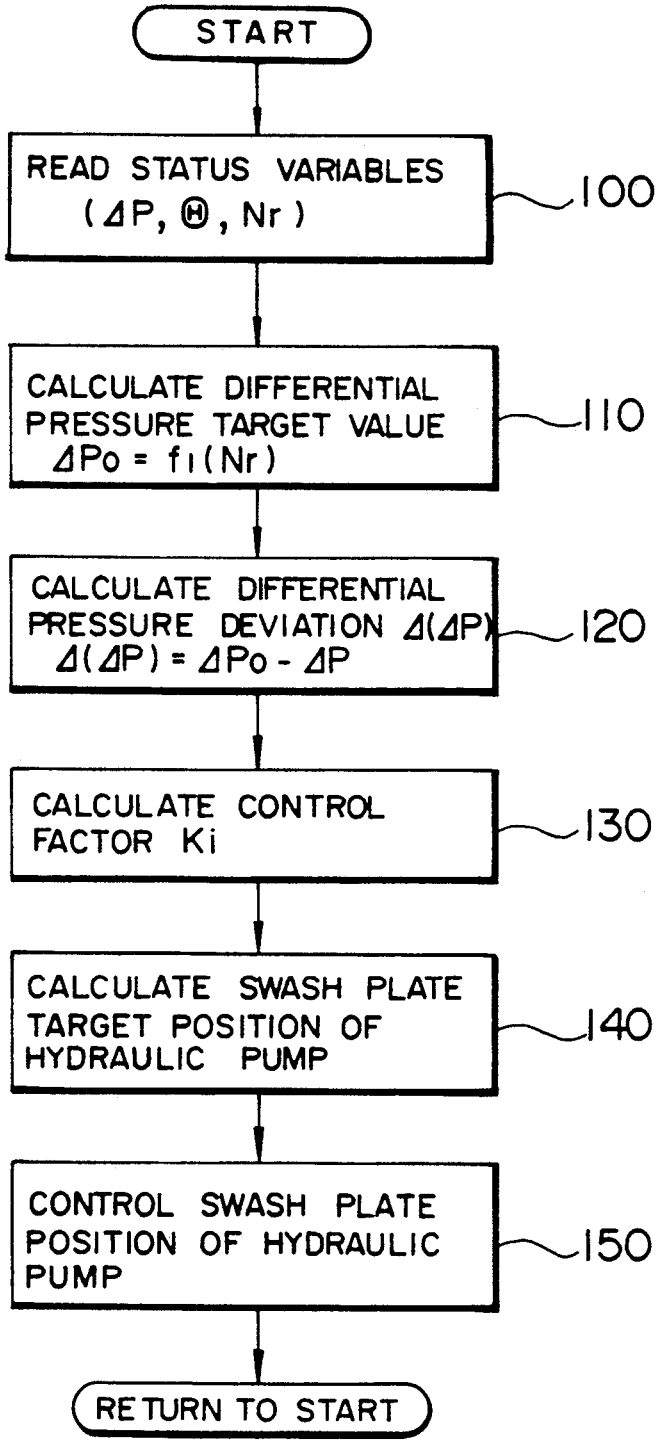
FIG. 4 is a flowchart showing the control sequence carried out in the control unit.

Then, in a step 132, the modifying factor $K_{\Delta P}$ determined in the step 131 is multiplied by the differential pressure deviation Δ(ΔP) determined in the step 120 in FIG. 4 to calculate a modified differential pressure deviation Δ(ΔP)*.

Figure 8:
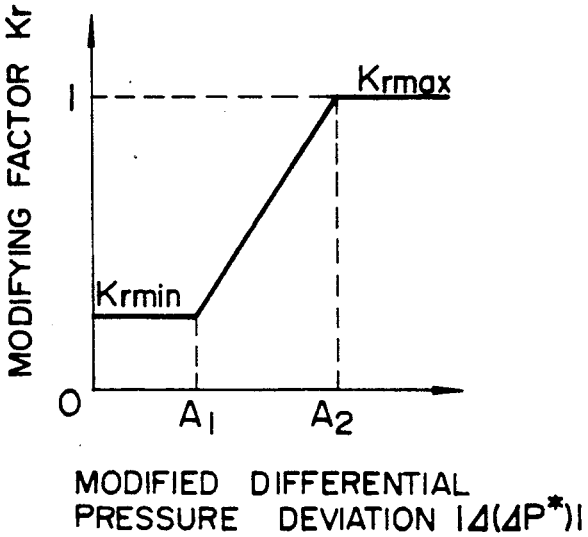
FIG. 8 is a graph showing the relationship between a modified differential pressure deviation Δ (ΔP)* and a modifying factor Kr.

Next, in a step 133, a second modifying factor Kr is calculated from the modified differential pressure deviation Δ(ΔP)*. The calculation is made by previously storing table data as shown in FIG. 8 in the ROM 7c, and reading the modifying factor Kr corresponding to an absolute value of the modified differential pressure deviation Δ(ΔP)* determined in the step 133. Alternatively, the modifying factor Kr may be determined through arithmetic operation by programming the calculation formula in advance. The relationship between the absolute value of the modified differential pressure deviation Δ(ΔP)* and the modifying factor Kr in the table data has such characteristics that, as shown in FIG. 8, the modifying factor Kr takes a minimum value Krmin when the absolute value of the modified differential pressure deviation Δ(ΔP)* is equal to or less than A1, takes a maximum value Krmax when the absolute value of the modified differential pressure deviation Δ(ΔP)* becomes equal to or greater than A2, and it is increased continuously from the minimum value Krmin to the maximum value Krmax as the absolute value of the modified differential pressure deviation Δ(ΔP)* increases in a range of from A1 to A2.

Here, the minimum value Krmin of the modifying factor Kr is set to such a value as providing the control factor Ki which enables to perform stable control without making the delivery pressure of the hydraulic pump 1 so abruptly change as to cause hunting, when the swash plate position θ of the hydraulic pump 1 is small and the target revolution speed Nr of the prime mover 15 is at the maximum Nrmax. The maximum value Krmax of the modifying factor Kr is set to such a value as to provide a control factor Ki which permits prompt control that is free from slow change in the pump delivery pressure. In this embodiment, particularly, the maximum value Krmax is set to 1. Note that Krmax may be set to a value other than 1. Also, the modifying factor Kr may be a value discontinuously changing between the minimum value Krmin and the maximum value Krmax.

Then, in a step 134, the modifying factor Kr determined in the step 133 is multiplied by a preset basic value Kio of the control factor to obtain the control factor Ki. In this case, the basic value Kio of the control factor is to set the maximum control factor dependent on the value of the modifying factor Kr. In this embodiment, since the modifying factor Kr is 1 when the absolute value of the modified differential pressure deviation Δ(ΔP)* is equal to or greater than A2, the basic value Kio is made coincident with such a value of the control factor Ki that prompt control is obtained free from slow change in the pump delivery pressure when the differential pressure deviation Δ(ΔP) is large. Alternatively, if the minimum value Krmin of the modifying factor Kr in FIG. 8 is set to 1, the basic value Kio of the control factor may be coincident with such a value of the control factor Ki that stable control is obtained without making the delivery pressure of the hydraulic pump 1 so abruptly changed as to cause hunting, when the swash plate position θ of the hydraulic pump 1 is small and the target revolution speed Nr of the prime mover 15 is at the maximum Nrmax. Further, if a value of the modifying factor Kr intermediate between the minimum value Krmin and the maximum value Krmax is set to 1, the basic value Kio may be coincident with such a value of the control factor Ki as enabling to perform optimum control for the differential pressure deviation Δ(ΔP) at that time.

Figure 9:
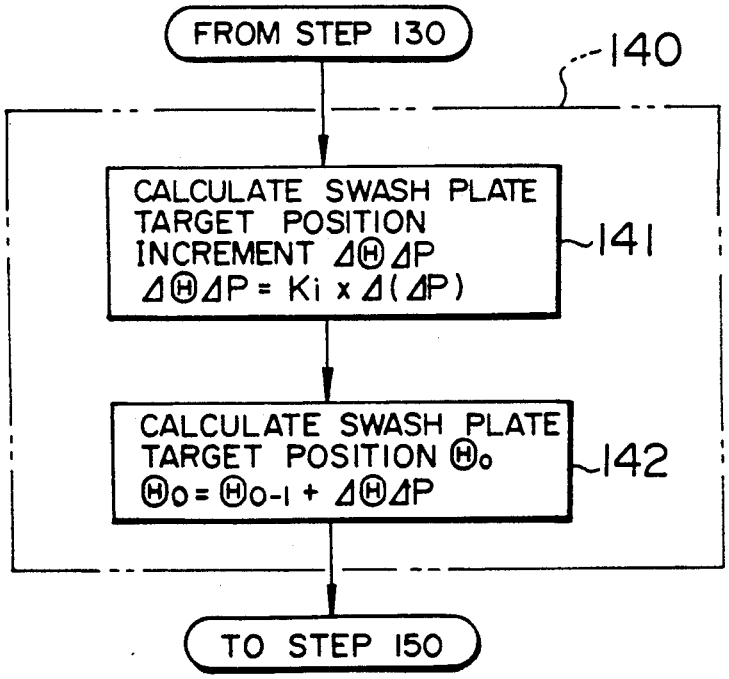
FIG. 9 is a flowchart showing details of a step of calculating a swash plate target position of the hydraulic pump in the flowchart of FIG. 4.

Next, returning to FIG. 4, a step 140 calculates a swash plate target position (i.e., a target tilting amount) of the hydraulic pump through integral control. FIG. 9 shows details of the step 140.

In FIG. 9, an increment $\Delta\theta_{\Delta P}$ of the swash plate target position is first calculated in a step 141. The calculation is performed by multiplying the differential pressure deviation Δ(ΔP) by the control factor Ki determined in the step 130. Assuming that a period of time required for the program proceeding from the step 100 to 150 (i.e., cycle time) is tc, the swash plate target position increment $\Delta\theta_{\Delta P}$ represents an increment of the swash plate target position for the cycle time tc and hence $\Delta\theta_{\Delta P}$/tc gives a target tilting speed of the swash plate.

Then, in a step 142, the increment $\Delta\theta_{\Delta P}$ is added to the swash plate target position θo−1 which has been calculated in the last cycle, to obtain the present (new) swash plate target position θo.

Figure 10:
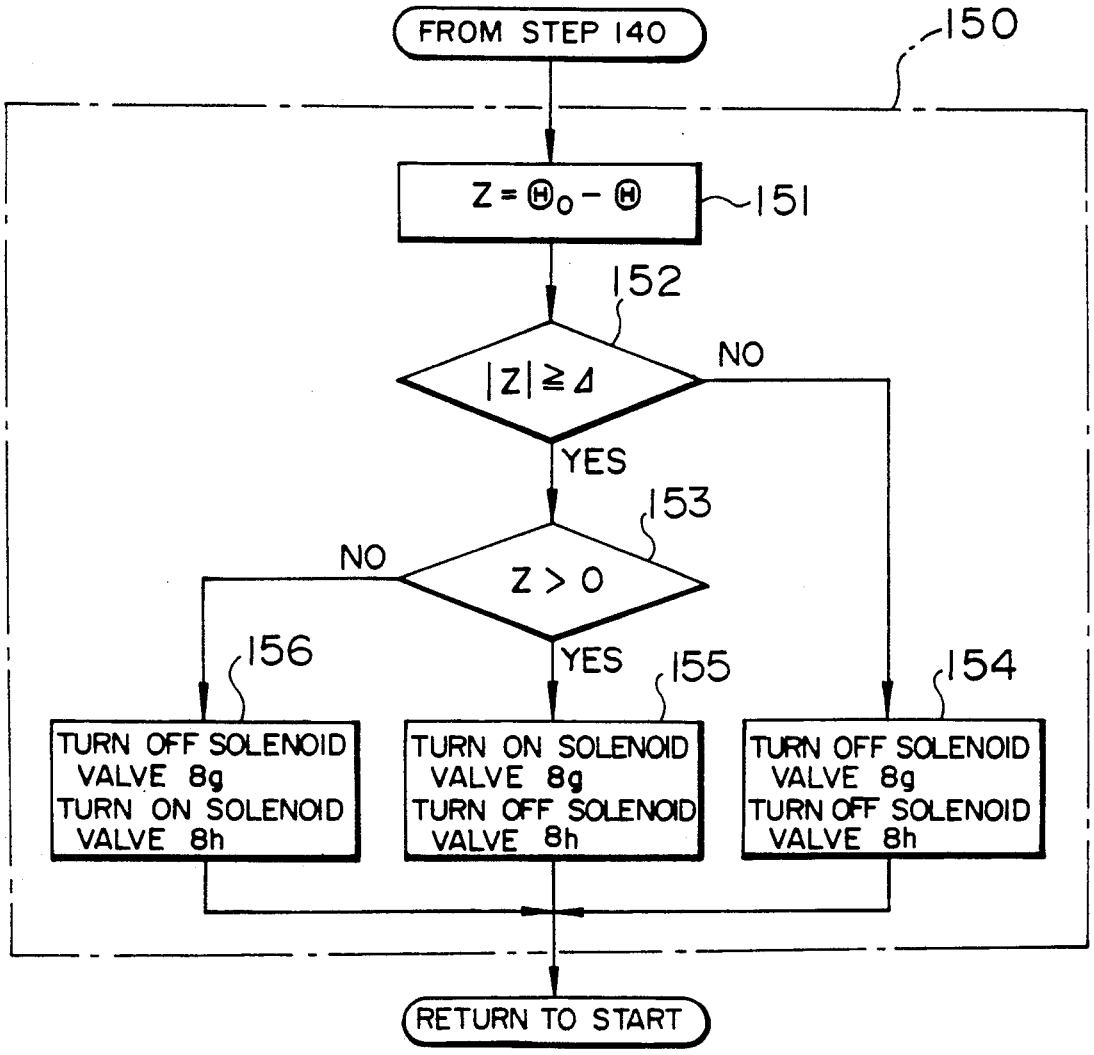
FIG. 10 is a flowchart showing details of a step of controlling the swash plate position of the hydraulic pump in the flowchart shown in FIG. 4.

Next, returning to FIG. 4, a step 150 controls the tilting position (tilting amount) of the hydraulic pump. FIG. 10 shows details of the step 150.

In FIG. 10, a deviation Z between the swash plate target position θo calculated in the step 140 and the swash plate position θ read in the step 100 is first calculated in a step 151. Then, in a step 152, it is determined whether an absolute value of the deviation Z is within a dead zone Δ for the swash plate position control. If |Z| is determined to be smaller than the dead zone Δ(|Z|<Δ), then the control flow proceeds to a step 154 where OFF signals are outputted to the solenoid valves 8g, 8h for rendering the swash plate position fixed. If |Z| is determined to be not smaller than the dead zone $\Delta(|Z| \geqq \Delta)$ in the step 152, then the control flow proceeds to a step 153. The step 153 determines whether Z is positive or negative. If Z is determined to be positive ($Z>0$), then the control flow proceeds to a step 155. In the step 155, an ON and OFF signal are outputted to the solenoid valves 8g and 8h, respectively, for moving the swash plate position in the direction to increase.

If Z is determined to be zero or negative ($Z \leqq 0$) in the step 153, then the control flow proceeds to a step 156. In the step 156, an OFF and ON signal are outputted to the solenoid valves 8g and 8h, respectively, for moving the swash plate position in the direction to decrease.

Through the foregoing steps 151–156, the swash plate position is so controlled as to coincide with the target position. Also, the above steps 100–150 are carried out once for the cycle time tc, resulting in that the tilting speed of the swash plate 1a is controlled to the aforesaid target speed $\Delta\theta_{\Delta P}$/tc.

Figure 11:
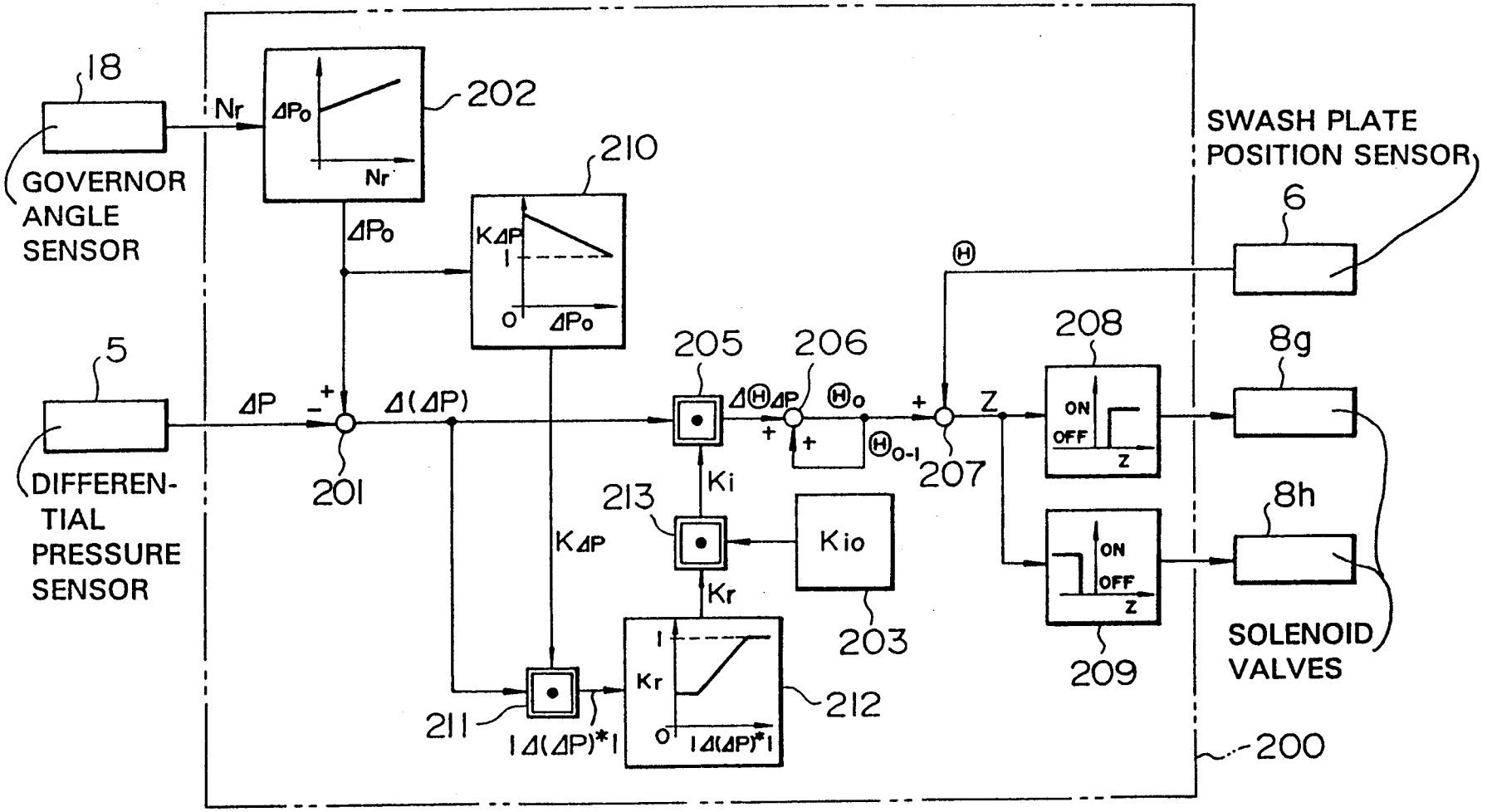
FIG. 11 is a block diagram showing control steps of the above embodiment together in the form of blocks.

The above-explained control steps are shown together in FIG. 9 in the form of blocks. In FIG. 11, an entire control block is indicated by 200. A block 202 corresponds to the step 110, a block 201 corresponds to the step 120, and blocks 210–213 and 203 correspond to the step 130, respectively. Among these last blocks, the block 210 corresponds to the step 131, the block 211 correspond to the step 132, the block 212 corresponds to the step 133, and the blocks 203, 213 correspond to the step 134, respectively. Further, the blocks 205, 206 corresponds to the step 140 and the blocks 207–209 correspond to the step 150.

Figure 12:
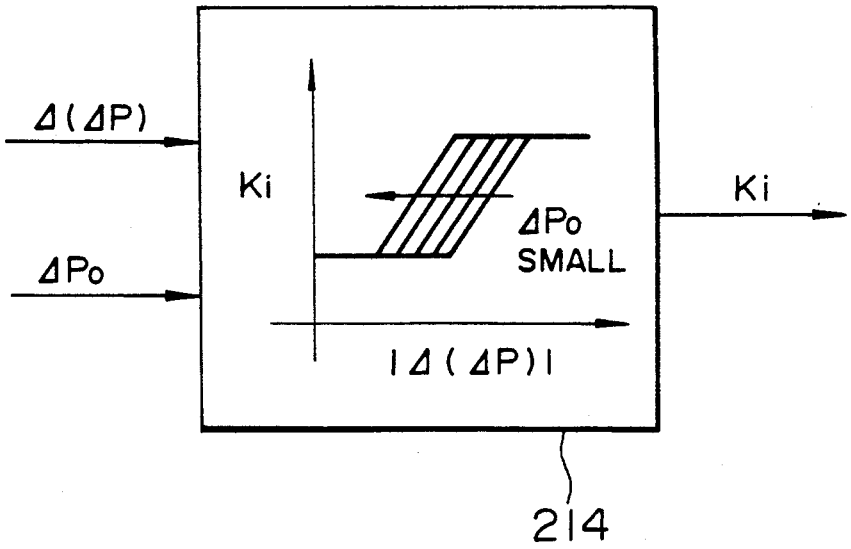
FIG. 12 is a block diagram showing primary functions in the block diagram of FIG. 11 together.

Additionally, functions of the blocks 210–213 and 203 in the above block diagram are shown together in FIG. 12 as a block 214. More specifically, the blocks 210–213 and 203 function to determine the control factor Ki which becomes larger as the differential pressure deviation $\Delta(\Delta P)$ calculated from the target differential pressure $\Delta Po$ as a variable value is increased, and becomes smaller as it is decreased, and also which becomes large at a relatively small value of the differential pressure deviation $\Delta(\Delta P)$ when the target differential pressure $\Delta Po$ is small. Accordingly, in FIG. 11, the block 202 constitutes first means including the target differential pressure $\Delta Po$ set as a variable value. The blocks 210–213 and 203 constitute second means for determining the control factor Ki which becomes larger as the differential pressure deviation $\Delta(\Delta P)$ calculated from the target differential pressure $\Delta Po$ as a variable value is increased, and becomes smaller as it is decreased, and also which becomes large at a relatively small value of the differential pressure deviation $\Delta(\Delta P)$ when the target differential pressure $\Delta Po$ is small. The blocks 205 and 206 constitute third means for determining the target displacement volume $\theta o$ based on the differential pressure deviation $\Delta(\Delta P)$ calculated from the target differential pressure $\Delta Po$ as a variable value and the control factor Ki.

When the control lever 3a of the actuator 2 is operated to open the flow control valve 3 to an arbitrary degree of opening, the differential pressure between the pump delivery pressure Pd and the load pressure PL of the actuator 2, i.e., the LS differential pressure $\Delta P$ is reduced. This reduction in the LS differential pressure $\Delta P$ is detected by the differential pressure sensor 5. In the control unit 7, the deviation $\Delta(\Delta P)$ between the detected LS differential pressure $\Delta P$ and the target differential pressure $\Delta Po$ preset as a variable value is calculated, following which this differential pressure deviation $\Delta(\Delta P)$ is multiplied by the control factor Ki to determine the increment of the swash plate target position (tilting amount), i.e., the target tilting speed $\Delta\theta_{\Delta P}$ of the swash plate. Then, this increment is added to the swash plate target value $\theta o-1$ in the last cycle to calculate the new swash plate target position $\theta o$. The swash plate is driven at the tilting speed of $\Delta\theta_{\Delta P}$ so as to make the actual swash plate position coincident with the swash plate target position $\theta o$, thereby controlling the LS differential pressure $\Delta P$. As a result, the delivery rate of the hydraulic pump 1 is controlled so that the LS differential pressure $\Delta P$ is held at the target differential pressure $\Delta Po$.

Further, in the above control process, the control factor Ki is determined below. Assuming now that the operation amount of the governer lever 17 is maximized and the target revolution speed Nr of the prime mover 15 is set to the maximum Nrmax, a large value, i.e., the maximum target differential pressure $\Delta Pomax$, is set as the target differential pressure in the block 202 of FIG. 11 correspondingly, and the first modifying factor $K_{\Delta P}$ obtained in the block 210 becomes 1. This modifying factor $K_{\Delta P}$ (=1) is multiplied by the differential pressure deviation $\Delta(\Delta P)$ in the block 211. In this case, because of $K_{\Delta P}=1$, the modified differential pressure deviation $\Delta$ $(\Delta P)^*$ equal to the differential pressure deviation $\Delta(\Delta P)$ is obtained. The second modifying factor Kr corresponding to the modified differential pressure deviation $\Delta(\Delta P)^*$ is determined in the block 212, and then multiplied by the basic value Kio in the block 213 to determine the control factor Ki.

Accordingly, assuming now that the operating speed of the control lever 3a is small, a reduction in the pump delivery pressure is small and the differential pressure deviation $\Delta(\Delta P)$ is also small, thus resulting in that the modifying factor Kr calculated in the block 212 of FIG. 11 takes a small value ($<1$), and so does the control coefficient Ki. Therefore, the swash plate target tilting speed $\Delta\theta_{\Delta P}$ also becomes small and the swash plate 1a is driven at the small tilting speed. Consequently, even with the opening of the flow control valve 3 being small, there can be performed stable control without making the delivery pressure of the hydraulic pump so abruptly changed as to cause hunting.

When the control lever 3a is operated at a large speed and the opening of the flow control valve 3 is abruptly increased, a reduction in the pump delivery pressure becomes large and the differential pressure deviation $\Delta(\Delta P)$ also becomes large, thus resulting in that the modifying coefficient Kr takes a large value (=1), and so does the control factor Ki. Therefore, the swash plate target tilting speed $\Delta\theta_{\Delta P}$ also becomes large and the swash plate 1a is driven at the large tilting speed. Consequently, there can be performed prompt control free from slow change in the pump delivery pressure. When the pump delivery rate approaches the demanded flow rate and the differential pressure deviation $\Delta(\Delta P)$ is reduced, the control factor Ki becomes small and so does the tilting speed of the swash plate 1a. As a result, the control is settled in a stable state free from hunting similarly to the above-mentioned case where the operating speed of the control lever 3 is small.

Figure 13:
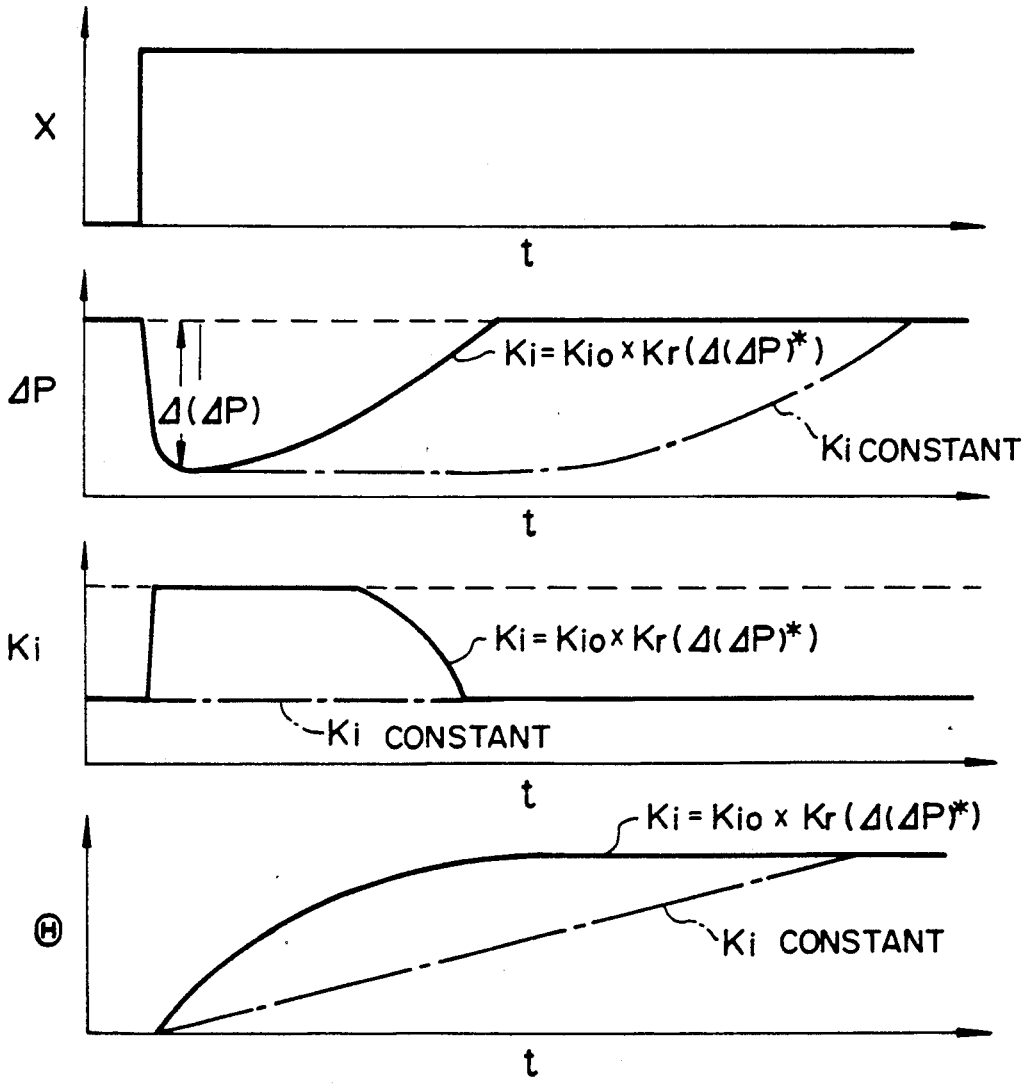
FIG. 13 is a chart showing the relationship in change over time between the opening of a flow control valve, the LS differential pressure, the control coefficient and the swash plate position when the target differential pressure is large.

FIG. 13 shows change in the operation amount (opening) X of the flow control valve 3, the LS differential pressure $\Delta P$, the control factor Ki and the tilting amount $\theta$ of the swash plate 1a over time in the above case where the differential pressure deviation $\Delta(\Delta P)$ is modified. In the drawing, one-dot chain lines represent change in the LS differential pressure $\Delta P$, the control coefficient Ki and the tilting amount $\theta$ of the swash plate over time, when the control factor Ki is set at a small constant value so as to perform stable control in a region where the opening X of the flow control valve is small. In the latter case, even when the opening X of the flow control valve is quickly increased, the control factor Ki is a small constant value so that the tilting speed of the swash plate is also small, which prolongs a period of time required for the differential pressure $\Delta P$ to return to the target differential pressure $\Delta Po$, causing the operator to feel that the excavator is too slow in action.

On the contrary, in this embodiment represented by solid lines in FIG. 13, when the opening X of the flow control valve 3 is quickly increased, a reduction in the pump delivery pressure becomes large and the differential pressure deviation $\Delta(\Delta P)$ also becomes large. Therefore, the control factor Ki takes a larger value and the tilting amount of the swash plate 1*a* is increased at a larger tilting speed. When the pump delivery rate approaches the demanded flow rate of the flow control valve 3, the differential pressure $\Delta P$ is gradually restored to reduce the differential pressure deviation $\Delta(\Delta P)$. Accordingly, the control factor Ki is also gradually decreased and, in a region where the differential pressure deviation $\Delta(\Delta P)$ becomes approximately zero, the control factor Ki takes a small value so that the differential pressure $\Delta P$ is settled to the target differential pressure $\Delta Po$ in a stable state. As a result, a period of time required to reach the demanded flow rate is shortened as compared with the case of setting the control factor Ki constant, making it possible to perform prompt and stable control without impeding an acceleration feeling of the actuator 2 perceived by the operator.

Consider now the case where the operator diminishes the operation amount of the governer lever 17 and decreases the target revolution speed Nr of the prime mover 15 with an intention for the fine speed operation. In this case, the small target differential pressure $\Delta Po$ corresponding to the target revolution speed thus set is obtained in the block 202 of FIG. 11 and the large modifying factor $K_{\Delta P}$ is obtained in the block 210 correspondingly. Therefore, the differential pressure deviation $\Delta(\Delta P)$ is modified to become large in the block 211 and the modifying factor Kr corresponding to the large differential pressure is obtained in the block 212, following which Kr is multiplied by the basic value Kio in the block 213 to determine the control factor Ki.

Meanwhile, because the differential pressure deviation $\Delta(\Delta P)$ cannot exceed the target differential pressure $\Delta Po$, as the target differential pressure $\Delta Po$ is reduced, a change width of the differential pressure deviation is also reduced correspondingly. Accordingly, when the control lever is operated at a large speed to abruptly increase the opening of the flow control valve 3, a reduction in the pump delivery pressure becomes large and so does the differential pressure deviation $\Delta(\Delta P)$. However, the resulting value of the differential pressure deviation $\Delta(\Delta P)$ is smaller than the value of the differential pressure deviation $\Delta(\Delta P)$ resulted when the target differential pressure $\Delta Po$ is large, for example, at $\Delta Pomax$. Accordingly, if the modifying factor Kr is calculated using the small differential pressure deviation as it is, a smaller value ($<1$) would be obtained rather than the maximum value Krmax ($=1$). This reduces the differential pressure deviation $\Delta(\Delta P)$ itself and hence the control factor Ki, whereby the target tilting speed $\Delta\theta_{\Delta P}$ calculated in the block 205 becomes so small that the pump delivery pressure is changed slowly and prompt control cannot be provided.

On the contrary, in this embodiment, since the differential pressure deviation $\Delta(\Delta P)$ is modified to become large in the block 211 and the modifying factor Kr is determined using the large modified differential pressure deviation $\Delta(\Delta P)^*$ as stated before, the modifying factor Kr is obtained as a large value, i.e., the maximum value Krmax ($=1$). Therefore, the control factor Ki also takes a larger value and the target tilting speed $\Delta\theta_{\Delta P}$ of the swash plate 1*a* is increased, whereby the swash plate is driven at a larger tilting speed as with the case that the target differential pressure $\Delta Po$ is large. As a result, there can be performed prompt control free from slow change in the pump delivery pressure. When the pump delivery rate approaches the demanded flow rate and the differential pressure deviation $\Delta(\Delta P)$ is decreased, the control factor Ki is also decreased to lower the tilting speed of the swash plate 1*a* and the control is settled in a stable state free from hunting.

Figure 14:
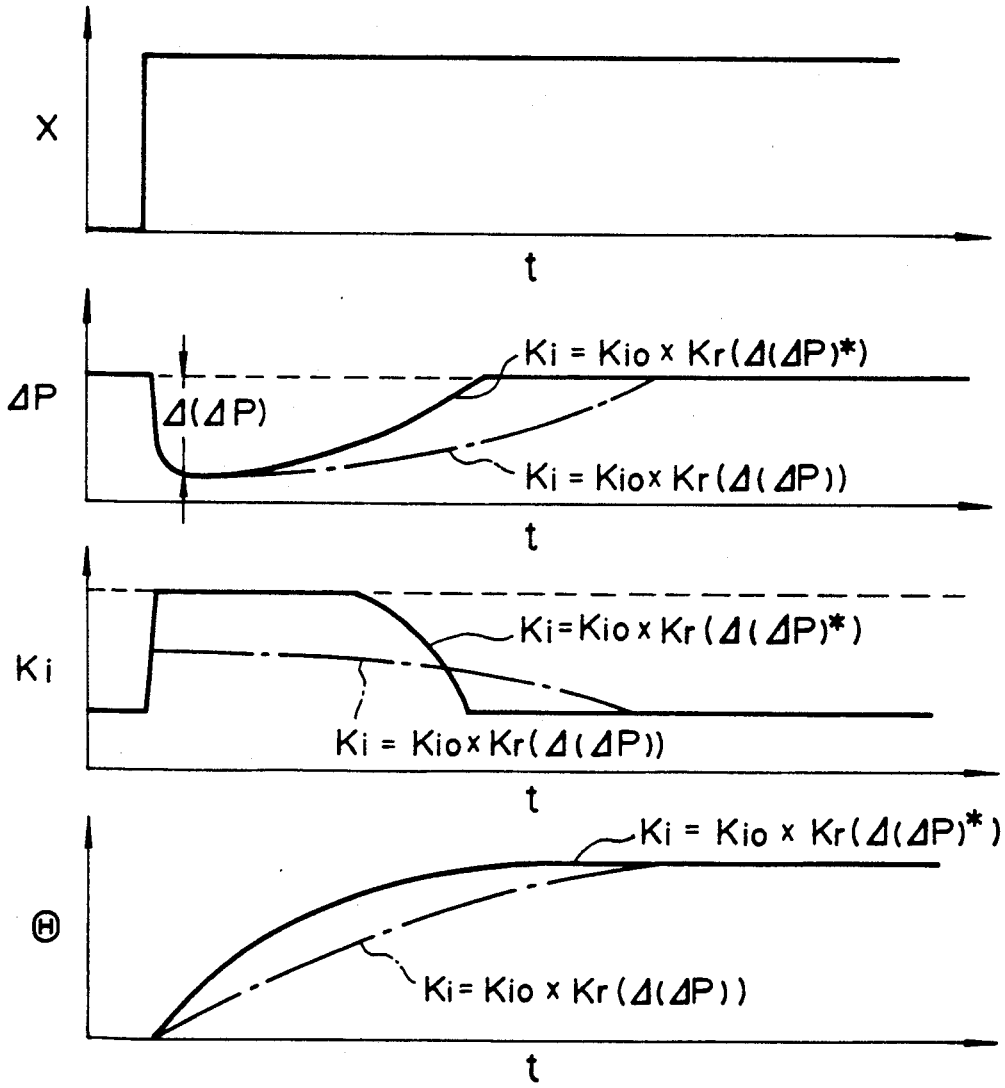
FIG. 14 is a chart showing the relationship in change over time between the opening of the flow control valve, the LS differential pressure, the control coefficient and the swash plate position when the target differential pressure is small.

FIG. 14 shows change in the operation amount (opening) X of the flow control valve 3, the LS differential pressure $\Delta P$, the control factor Ki and the tilting amount $\theta$ of the swash plate 1*a* over time in the above case where the differential pressure deviation $\Delta(\Delta P)$ is modified. In the drawing, one-dot chain lines represent change in the LS differential pressure $\Delta P$, the control coefficient Ki and the tilting amount $\theta$ of the swash plate over time, when the differential pressure deviation $\Delta(\Delta P)$ is not modified and control factor Ki is determined directly therefrom. In the latter case, even when the opening X of the flow control valve is quickly increased, change in the differential pressure deviation $\Delta(\Delta P)$ is small and the control factor Ki becomes small. Accordingly, the tilting speed of the swash plate is also small, which prolongs a period of time required for the differential pressure $\Delta P$ to return to the target differential pressure $\Delta Po$, causing the operator to feel that the excavator is too slow in action.

On the contrary, in this embodiment, since the differential pressure deviation $\Delta(\Delta P)$ is modified to become large and the modifying factor Kr is determined using the large modified differential pressure deviation $\Delta(\Delta P)^*$, the control factor Ki takes a larger value and the tilting amount of the swash plate 1*a* is increased to a greater tilting speed as indicated by solid lines in FIG. 14. When the pump delivery rate approaches the demanded flow rate of the flow control valve 3, the differential pressure $\Delta P$ is gradually restored to reduce the differential pressure deviation $\Delta(\Delta P)$. Accordingly, the control factor Ki is also gradually decreased and, in a region where the differential pressure deviation $\Delta(\Delta P)$ becomes approximately zero, the control factor Ki takes a small value so that the differential pressure $\Delta P$ is settled to the target differential pressure $\Delta Po$ in a stable state. In other words, the control can be performed following substantially the same change over time as the case where the target differential pressure $\Delta Po$ is large. As a result, a period of time required to reach the demanded flow rate is shortened as compared with the case of not modifying the differential pressure deviation $\Delta(\Delta P)$, making it possible to perform prompt and stable control without impeding an acceleration feeling of the actuator 2 perceived by the operator.

Further, with the target differential pressure $\Delta Po$ set small as mentioned above, the differential pressure between the pump delivery pressure and the load pressure of the actuator 2 is controlled so as to be coincident with that small target differential pressure, the differential pressure across the flow control valve 3 is reduced by being restricted by the small differential pressure and the flow rate of the hydraulic fluid passing through the flow control valve 3. Accordingly, corresponding to the operator's intention of lowering the revolution speed of the prime mover to carry out the fine speed operation, the driving speed of the actuator is decreased to facilitate the fine speed operation and improve the operability.

With this embodiment, as explained above, when the operating speed of the flow control valve is small and the opening thereof is also small, there can be performed stable control in which the pump delivery pressure will not be so abruptly changed as to cause hunting. When the control lever is operated at a large speed to quickly increase the opening of the flow control valve, there can be provided a prompt response free from slow change in the delivery pressure of the hydraulic pump 1. In addition, that effect can be obtained irrespective of values of the target differential pressure ΔPo.

Further, with this embodiment, since the target differential pressure ΔPo is made smaller as the revolution speed of the prime mover decreases, the driving speed of the actuator is decreased corresponding to the operator's intention of lowering the revolution speed of the prime mover to carry out the fine speed operation, resulting in the advantage of facilitating the fine speed operation and improving the operability.

In the above embodiment, the target differential pressure ΔPo is set as a function of the target revolution speed Nr of the prime mover so that the target differential pressure ΔPo is determined by using the target revolution speed Nr. However, a revolution speed sensor 19 for detecting a revolution speed Ne of the output shaft of the engine 15 may be installed as indicated by imaginary lines in FIG. 1 to determine the target differential pressure ΔPo by using the actual revolution speed (output revolution speed) of the engine 15 detected by the sensor 19. In this case, the similar control can be performed as well. Alternatively, since the rotation of the engine 15 is transmitted to the hydraulic pump 1 after being reduced down in speed through a speed reducer 20, it is also possible to install a revolution speed sensor 21 for directly detecting a reduced revolution speed Np of the hydraulic pump 1 and use the detected revolution speed in determining the target differential pressure ΔPo.

Figure 15:
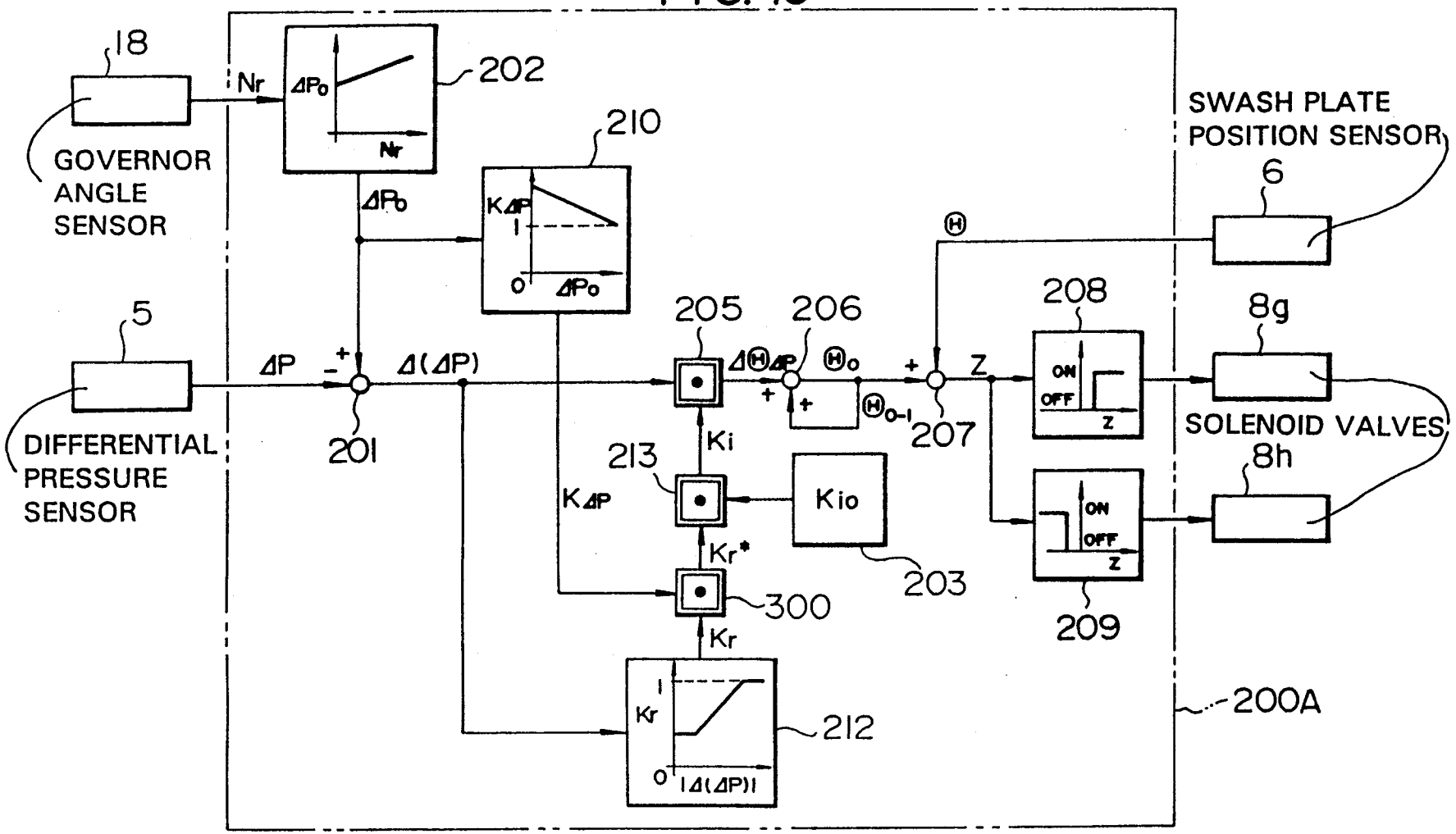
FIG. 15 is a block diagram similar to FIG. 11, showing a control system for a hydraulic pump according to a second embodiment of the present invention.

A second embodiment of the present invention will be described below with reference to FIGS. 15 and 16. In these drawings, an entire control block is denoted by 200A and the same function blocks in the block 200A as those in FIG. 11 are denoted by the same reference numerals.

This second embodiment is different from the above first embodiment in the procedure to modify the modifying factor $K_{\Delta P}$ used in calculating the control factor Ki from the differential pressure deviation Δ(ΔP). More specifically, in this embodiment, the differential pressure deviation Δ(ΔP) calculated in the block 201 is directly inputted to the block 212 to determine the modifying factor Kr. Thereafter, in a block 300, the modifying factor Kr is multiplied by the modifying factor $K_{\Delta P}$ determined in the block 210 to obtain a modifying factor Kr* modified. The subsequent procedure of determining the control factor Ki from the modifying factor Kr* is the same as that in the above first embodiment.

Figure 16:
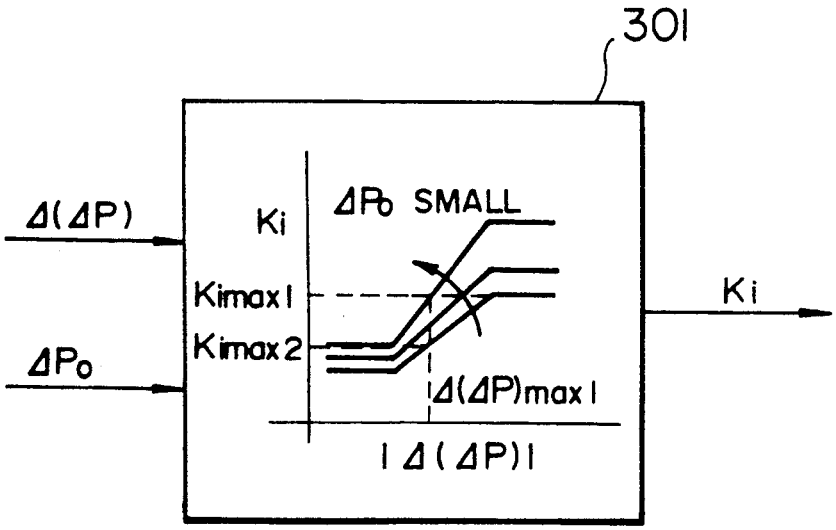
FIG. 16 is a block diagram showing primary functions in the block diagram of FIG. 15 together.

Functions of the blocks 210, 212, 213 and 300 in the second embodiment are shown together in FIG. 16 as a block 301. More specifically, as with the block 214 shown in FIG. 12, the block 301 functions to determine the control factor Ki which becomes larger as the differential pressure deviation Δ(ΔP) calculated from the target differential pressure ΔPo as a variable value is increased, and becomes smaller as it is decreased, and also which becomes large at a relatively small value of the differential pressure deviation Δ(ΔP) when the target differential pressure ΔPo is small. In the second embodiment shown in FIG. 15, the control factor Ki is thereby modified dependent on change in the target differential pressure ΔPo as with the first embodiment. In other words, even when the target differential pressure ΔPo becomes small and the differential pressure deviation Δ(ΔP) is correspondingly small, for example, Δ(ΔP)max1, upon the control lever being operated at a large speed, the resulting control factor Ki is modified from Kimax2 to a value as large as Kimax1 that is the maximum value in the case where the target differential pressure is large. Accordingly, this embodiment can also improve a response at a small value of the target differential pressure similarly to the first embodiment, and provide a prompt response free from slow change in the delivery pressure of the hydraulic pump 1 when the control lever is operated at a large speed, thereby offering the same advantageous effect as the first embodiment.

There are various possible methods of modifying the control factor Ki dependent on change in the target differential pressure, and this procedure may be practiced by other methods than as set forth above. For example, the differential pressure deviation Δ(ΔP) may be modified by directly using the target differential pressure ΔPo, or the relationship between the differential pressure deviation Δ(ΔP) and the modifying factor Kr may be set in advance, followed by modifying that relationship with the modifying factor $K_{\Delta P}$. Although the control factor Ki has been determined from both the modifying factor Kr and the basic value Kio of the control factor, it may be determined in a direct manner.

Figure 17:
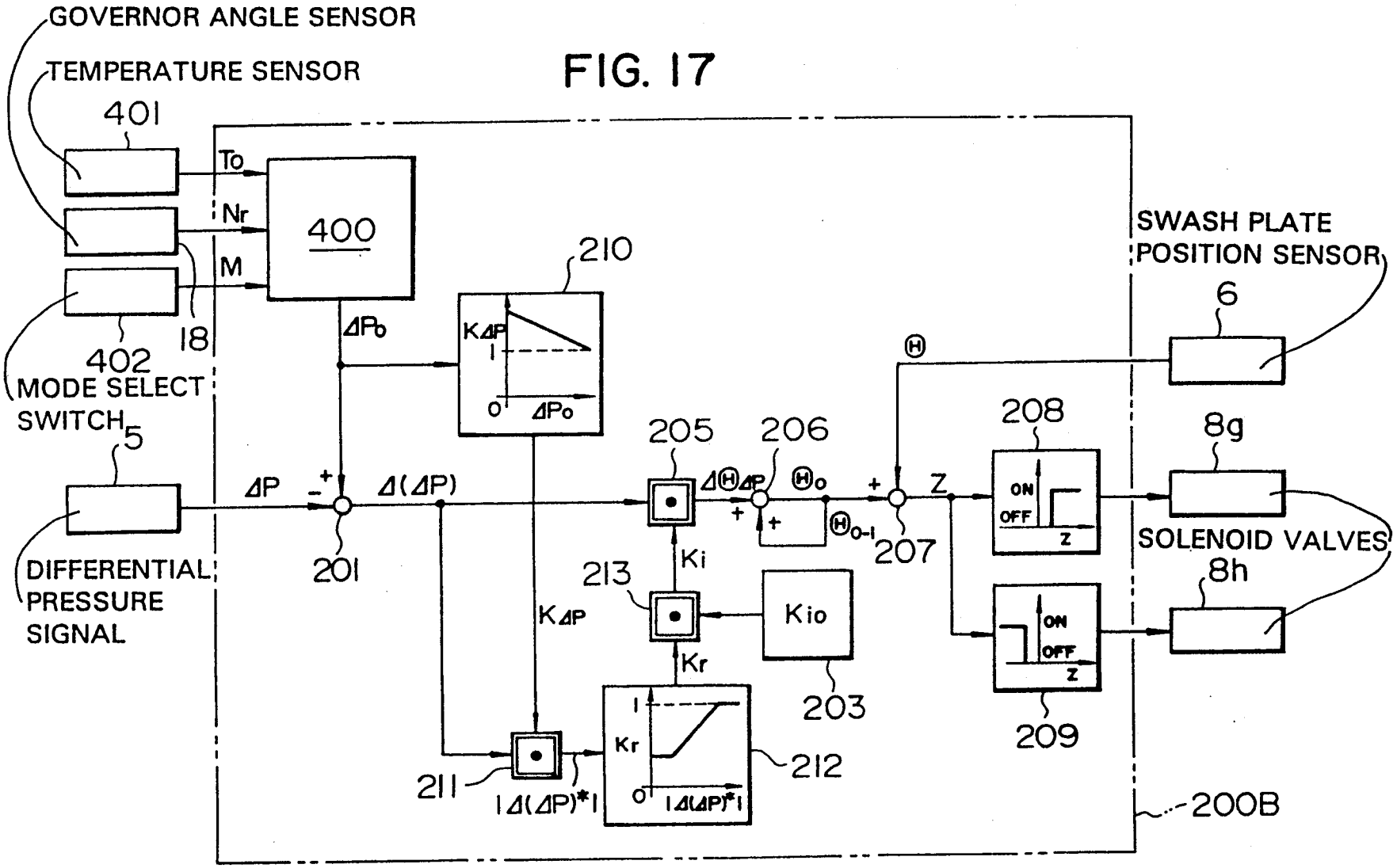
FIG. 17 is a block diagram similar to FIG. 11, showing a control system for a hydraulic pump according to a third embodiment of the present invention.

A third embodiment of the present invention will be described below with reference to FIGS. 17 and 18. In these drawings, an entire control block is denoted by 200B and the same function blocks in the block 200B as those in FIG. 11 are denoted by the same reference numerals.

This third embodiment is different from the above first embodiment in the procedure of setting the target differential pressure ΔPo as a variable value. More specifically, in FIG. 17, inputted to a block 400 are the governer lever operation amount signal Nr outputted from the governer angle sensor 18 and corresponding to the target revolution speed of the engine, as well as a fluid (oil) temperature signal To from a temperature sensor 401 for detecting a fluid temperature in the hydraulic circuit and a work mode signal M from a work mode select switch 402 operated by the operator. The target differential pressure ΔPo as a variable value is determined from those input values. Since the hydraulic drive circuit of this embodiment is mounted on a hydraulic excavator, it is supposed that work modes designated by the select switch 402 include normal work, groove digging, level pulling and crane work.

Figure 18:
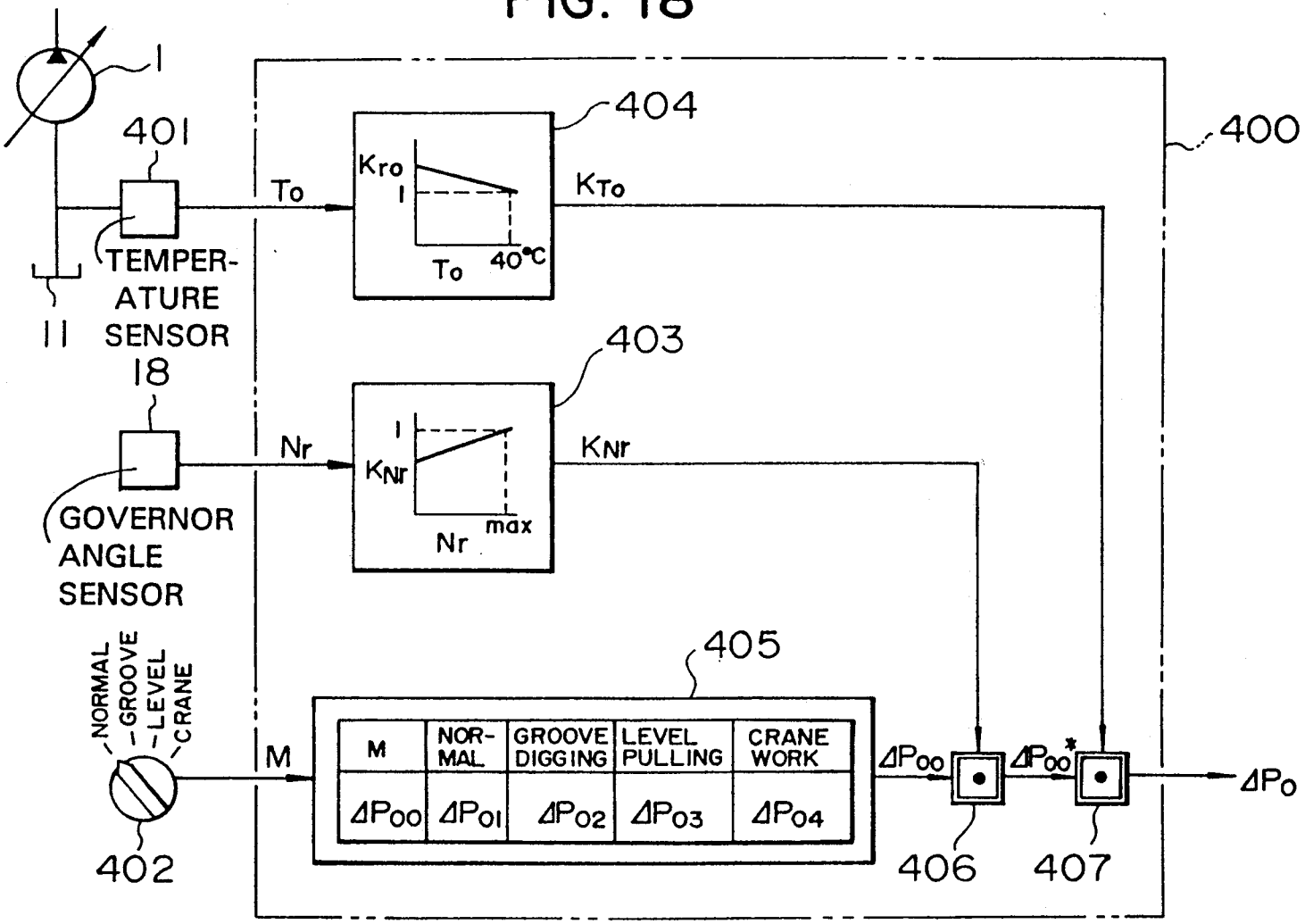
FIG. 18 is a block diagram showing primary functions in the block diagram of FIG. 17 together.

FIG. 18 shows details of the block 400. In FIG. 18, a block 403 serves to determine a revolution speed modifying factor KNr dependent on the target revolution speed Nr based on table data stored in advance. The relationship between the target revolution speed Nr and the revolution speed modifying factor KNr in the table data has such characteristics, like the relationship between the target revolution speed Nr and the target differential pressure ΔPo shown in FIG. 11, that KNr is increased as Nr becomes higher and is decreased as Nr becomes lower. In this embodiment, particularly, a maximum value of KNr obtained when Nr is at a maximum Nrmax is set to become 1.

The reason of so setting the relationship between the target revolution speed Nr and the revolution speed modifying factor KNr is in modifying the metering characteristics of the flow control valve such that the flow rate of the hydraulic fluid supplied to the actuator at a small value of Nr is reduced corresponding to the operator's intention of lowering the revolution speed of the prime mover to carry out the fine speed operation, as with the relationship between the target revolution speed Nr and the target differential pressure ΔPo, thereby facilitating the fine speed operation.

Further, a block 404 serves to determine a fluid temperature modifying factor KTo dependent on the fluid temperature To based on table data stored in advance. The relationship between the fluid temperature To and the fluid temperature modifying factor KTo in the table data has such characteristics that KTo is decreased as To becomes higher and is increased as To becomes lower. In this embodiment, particularly, a minimum value of KTo obtained when To is approximately at 40° C. as a normal fluid temperature is set to become 1.

The reason of so setting the relationship between the fluid temperature To and the fluid temperature modifying factor KTo is as follows. When the ambient temperature is lowered and viscosity of the hydraulic fluid in the hydraulic circuit is increased, the pump delivery rate at the same target differential pressure ΔPo is reduced due to the viscous resistance. Thus, by so setting the relationship, such an influence caused by viscosity can be canceled out.

Additionally, a block 405 serves to determine a target differential pressure ΔPoo dependent on the work mode signal M based on table data stored in advance. As versions of the target differential pressure ΔPoo, there are stored a target differential pressure ΔPo1 used when the work mode signal M designates normal work of the hydraulic excavator, a target differential pressure ΔPo2 used when it designates groove digging, a target differential pressure ΔPo3 used when it designates level pulling, and a target differential pressure ΔPo4 used when it designates crane work. These target differential pressures are set in the relationship of ΔPo2>Po1>Po3->Po4.

The reason of making the differential pressures different from each other dependent on the contents of work is in that the driving amount and operating speed demanded for the actuator are different for each kind of work. By way of example, in the crane work requiring fine speed operation, the target differential pressure ΔPo4 is set to a minimum value for facilitating the fine speed operation. In the groove digging requiring a high boom-up speed, the target differential pressure ΔPo1 is set to a maximum value for lifting a boom fast. By so changing the target differential pressure dependent on the contents of work, the working efficiency can be improved remarkably.

The target differential pressure ΔPoo determined in the block 405 is inputted to a block 406 where the target differential pressure ΔPoo is multiplied by the revolution speed modifying factor KNr obtained in the block 403 to determine a target differential pressure ΔPoo*. In a block 407, this target differential pressure ΔPoo* is then multiplied by the fluid temperature modifying factor KTo obtained in the block 404 to determine the target differential pressure ΔPo.

The subsequent procedure of determining the control factor Ki after the calculation of the target differential pressure ΔPo is the same as that in the first embodiment.

Consequently, as with the first embodiment, this embodiment can also provide a prompt response free from slow change in the delivery pressure of the hydraulic pump 1 no matter what a value of the target differential pressure ΔPo.

Further, with this embodiment, since the target differential pressure ΔPo is changed dependent on not only the revolution speed of the prime mover, but also the temperature of the hydraulic fluid and the work mode, the fine speed operation is facilitated corresponding to the operator's intention of lowering the revolution speed of the prime mover to carry out the fine speed operation, like the first embodiment. Moreover, an influence of the fluid temperature on viscosity of the hydraulic fluid can be canceled out to prevent a reduction in the driving speed of the actuator even during works under the low-temperature environment such as in winter or a cold area, and optimum metering characteristics dependent on the contents of work can be provided, thereby remarkably improving the operability and the working efficiency.

INDUSTRIAL APPLICABILITY

According to the present invention, even in the case of setting the target differential pressure as a variable value, it is possible to make control, not slow in response, under the optimum pump delivery pressure without causing hunting.

When the operator lowers the revolution speed of the prime mover with an intention of doing fine speed operation of the actuator, the target differential pressure becomes small with the reduced revolution speed of the prime mover. This also reduces the flow rate of the hydraulic fluid supplied to the actuator, making it possible to facilitate the fine speed operation corresponding to the operator's intention and improve the operability.

Further, since the target differential pressure becomes large in works under the low-temperature environment, it is possible to prevent a reduction in the flow rate of the hydraulic fluid supplied to the actuator and thus improve the working efficiency.

In addition, since the optimum target differential pressure is set dependent on the work mode, optimum metering characteristics dependent on the contents of work can be provided to further improve the working efficiency.

We claim:

1. A control system for a hydraulic pump in a hydraulic drive circuit of load sensing control type comprising at least one hydraulic pump of variable displacement type, at least one hydraulic actuator driven by a hydraulic fluid delivered from said hydraulic pump, and a flow control valve connected between said hydraulic pump and said actuator for controlling a flow rate of the hydraulic fluid supplied to said actuator, wherein a target displacement volume is determined based on a differential pressure deviation between a differential pressure between a delivery pressure of said hydraulic pump and a load pressure of said actuator and a target differential pressure whereby a displacement volume of said hydraulic pump is controlled so that said differential pressure between the delivery pressure and the load pressure is held at said target differential pressure, said control system for a hydraulic pump further comprising:

(a) first means including said target differential pressure set as a variable value;

(b) second means for determining a control factor that becomes larger as said differential pressure deviation calculated from said target differential pressure as a variable value is increased and becomes smaller as said differential pressure deviation is decreased, and also that becomes larger as said target differential pressure becomes smaller; and (c) third means for determining said target displacement volume based on said differential pressure deviation calculated from said target differential pressure as a variable value and said control factor.

2. A control system for a hydraulic pump according to claim 1, wherein said second means comprises fourth means for modifying a change width of said differential pressure deviation to be enlarged when said target differential pressure is small, and fifth means for determining said control factor based on said modified differential pressure deviation.

3. A control system for a hydraulic pump according to claim 2, wherein said fourth means comprises means for calculating a first modifying factor that becomes larger as said target differential pressure is decreased, and means for multiplying said differential pressure deviation by said first modifying factor to modify said differential pressure deviation.

4. A control system for a hydraulic pump according to claim 2, wherein said fifth means comprises means for calculating, from said modified differential pressure deviation, a second modifying factor that becomes larger as said modified differential pressure deviation is increased, and becomes smaller as said modified differential pressure deviation is decreased, means including a basic control factor set in advance, and means for multiplying said basic control factor by said second modifying factor to calculate said control factor.

5. A control system for a hydraulic pump according to claim 1, wherein said second means comprises means for calculating a first modifying factor that becomes larger as said target differential pressure is decreased, means for calculating, from said differential pressure deviation, a second modifying factor that becomes larger as said differential pressure deviation is increased, and becomes smaller as said differential pressure deviation is decreased, and means for multiplying said first modifying factor by said second modifying factor to calculate said control factor.

6. A control system for a hydraulic pump according to claim 1, wherein said second means comprises means for calculating a second modifying factor that becomes larger as said differential pressure deviation is increased, and becomes smaller as said differential pressure deviation is decreased, and also that becomes large at a relatively small value of said differential pressure deviation when said target differential pressure is small, means including a basic control factor set in advance, and means for multiplying said basic control factor by said second modifying factor to calculate said control factor.

7. A control system for a hydraulic pump according to claim 1, further comprising means for detecting a revolution speed of a prime mover to drive said hydraulic pump, wherein said first means sets said target differential pressure as a value that becomes larger as said detected revolution speed is increased, and becomes smaller as said detected revolution speed is decreased.

8. A control system for a hydraulic pump according to claim 1, further comprising means for detecting a temperature of the hydraulic fluid in said hydraulic drive circuit, wherein said first means sets said target differential pressure as a value that becomes smaller as said detected fluid temperature is raised, and becomes larger as said detected fluid temperature is lowered.

9. A control system for a hydraulic pump according to claim 1, further comprising means for outputting a work mode signal comprising means for outputting a work mode signal to designate a work mode of a hydraulic machine mounting said hydraulic drive circuit thereon, wherein said first means stores a plurality of different target differential pressures respectively corresponding to a plurality of work modes and selects the target differential pressure corresponding to the work mode designated by said work mode signal.

10. A control system for a hydraulic pump according to claim 1, further comprising means for detecting a revolution speed of a prime mover to drive said hydraulic pump, means for detecting a temperature of the hydraulic fluid in said hydraulic drive circuit, and means for outputting a work mode signal to designate a work mode of a hydraulic machine mounting said hydraulic drive circuit thereon, wherein said first means comprises means for calculating a revolution speed modifying factor that becomes larger as said detected revolution speed is increased, and becomes smaller as said detected revolution speed is decreased, means for calculating a fluid temperature modifying factor that becomes smaller as said detected fluid temperature is raised, and becomes larger as said detected fluid temperature is lowered, means for storing a plurality of different target differential pressures respectively corresponding to a plurality of work modes and selecting the target differential pressure corresponding to the work mode designated by said work mode signal, and means for calculating said target differential pressure as a variable value from said target differential pressure corresponding to the designated work mode, said revolution speed modifying factor and said fluid temperature modifying factor.

11. A control system for a hydraulic pump according to claim 1, wherein said fourth means comprises means for multiplying said differential pressure deviation by said control factor to calculate a target change speed of said displacement volume, and means for adding said target change speed to the target displacement volume obtained in the last cycle to determine a new target displacement volume.

* * * * *